US007762648B2

(12) United States Patent
Kyoso

(10) Patent No.: US 7,762,648 B2
(45) Date of Patent: Jul. 27, 2010

(54) LIQUID EJECTION APPARATUS AND IMAGE FORMING APPARATUS COMPRISING LIQUID EJECTION APPARATUS

(75) Inventor: Tadashi Kyoso, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 805 days.

(21) Appl. No.: 11/717,109

(22) Filed: Mar. 13, 2007

(65) Prior Publication Data

US 2007/0216727 A1 Sep. 20, 2007

(30) Foreign Application Priority Data

Mar. 14, 2006 (JP) ..... 2006-069848

(51) Int. Cl.
*B41J 2/165* (2006.01)

(52) U.S. Cl. ..... 347/22; 347/30

(58) Field of Classification Search ..... 347/17, 347/22–36

See application file for complete search history.

(56) References Cited

U.S. PATENT DOCUMENTS 6,612,683 B2 * 9/2003 Takahashi et al. ..... 347/30

FOREIGN PATENT DOCUMENTS

JP 11-314376 A 11/1999

* cited by examiner

*Primary Examiner*—Juanita D Stephens
(74) *Attorney, Agent, or Firm*—Birch, Stewart, Kolasch & Birch, LLP

(57) ABSTRACT

The liquid ejection apparatus includes: a liquid ejection head which comprises nozzles including at least one suctioned nozzle and at least one non-suctioned nozzle and ejecting liquid, pressure chambers supplying the nozzles with the liquid, and a common liquid chamber supplying the pressure chambers with the liquid; and an individual suctioning unit which suctions the liquid in the at least one suctioned nozzle, wherein when the individual suctioning unit suctions the liquid in the at least one suctioned nozzle, a following inequality is satisfied: P0−ΔPin<Pn, where Pn is an internal pressure of the at least one non-suctioned nozzle of which the liquid is not suctioned by the individual suctioning unit, and P0−ΔPin is a first limit value of the internal pressure of the at least one non-suctioned nozzle above which air does not flow into the at least one non-suctioned nozzle.

13 Claims, 29 Drawing Sheets

LIQUID EJECTION APPARATUS AND IMAGE FORMING APPARATUS COMPRISING LIQUID EJECTION APPARATUS

BACKGROUND OF THE INVENTION

1. Field of the Invention

The present invention relates to a liquid ejection device and an image forming apparatus comprising a liquid ejection device, and more particularly, to a liquid ejection device which includes a suctioning mechanism for restoring ejection when a nozzle blockage or the like has occurred and which ejects ink onto a recording medium, or the like, to form an image, and to an image forming apparatus comprising such a liquid ejection device.

2. Description of the Related Art

As an image forming apparatus in the related art, an inkjet printer (inkjet recording apparatus) is known, which includes an inkjet head (liquid ejection head) having a plurality of liquid ejection nozzles arranged and which records an image on a recording medium by ejecting ink (liquid) from the nozzles toward the recording medium while causing the inkjet head and the recording medium to move relatively to each other.

The inkjet head of an inkjet printer of this kind has pressure generating units. Each pressure generating unit includes: for example, a pressure chamber to which ink is supplied from an ink tank via an ink supply channel; a piezoelectric element which is driven by an electrical signal in accordance with image data; a diaphragm which constitutes a portion of the pressure chamber and deforms in accordance with the driving of the piezoelectric element; and a nozzle which is connected to the pressure chamber. The ink inside the pressure chamber is ejected in the form of a droplet from the nozzle when the volume of the pressure chamber is reduced by the deformation of the diaphragm. In an inkjet printer, one image is formed on the recording medium by combining dots formed by ink ejected from the nozzles of the pressure generating units.

An inkjet printer of this kind records an image by ejecting ink directly from very fine nozzles, and hence there are possibilities of ejection defects caused by the abnormality state of the nozzles and printing defects caused by ejection failures. Therefore, it is necessary to maintain the ink in a state which allows normal ejection at all times.

In particular, in an on-demand inkjet printer which ejects ink only when an image signal is input, there may be nozzles which do not perform ink ejection over a long period of time. In this case, the ink solvent may evaporate from the nozzles, the viscosity of the ink may increase, the ink may dry, and ejection defects may occur. Furthermore, phenomena of this kind may also occur if a recording operation is not carried out for a long period of time.

Moreover, in recent years, there has been a tendency for the number of nozzles to increase in inkjet head in order to increase printing speed. In order to restore a head suffering ejection defects, generally, a method is used in which the ink inside the pressure chambers is exchanged by suctioning the liquid inside the nozzles in the liquid ejection direction.

When suctioning of this kind is carried out in a head having a large number of nozzles, the ink inside all of the pressure chambers is exchanged. Hence, even the ink inside nozzles which perform normal ejections is also exchanged, and ink wastage thus occurs.

Consequently, in order to eliminate wasted consumption of ink, an "individual suctioning" technique has been contrived in which the nozzles of the inkjet head are divided into a plurality of regions, and suctioning is carried out only in a region including a nozzle which needs to be suctioned. When suctioning is carried out only for nozzles which require suctioning, from among the plurality of nozzles in the inkjet head, the ink is drawn in the liquid ejection direction from the nozzles where suctioning is carried out. Generally, the ink is supplied to the nozzles through a common flow channel, and the nozzles are interconnected via this common flow channel. Therefore, the force which moves the ink inside the suctioned nozzles in the liquid ejection direction, is also transmitted to other nozzles (non-suctioned nozzles) which are not suctioned, via the common flow channel. Due to this force being transmitted to other nozzles which are not suctioned, the ink inside these nozzles is caused to flow back. In this case, there is a possibility that air, or the like, may flow into the nozzles which are not suctioned.

In view of this, Japanese Patent Application Publication No. 11-314376 discloses a composition in which an opening and closing valve, or the like, is provided between each nozzle and the common flow channel inside the inkjet head. By adopting a composition of this kind, it is possible to prevent the ink from flowing back, and therefore it is possible to prevent air, or the like, from flowing into nozzles which are not suctioned.

However, if such an opening and closing valve is provided, then the cost of the inkjet head rises accordingly. In practice, it is difficult in manufacturing terms to provide such opening and closing valves inside an inkjet head, and the provision of the opening and closing valves leads to an increase in the size of the apparatus. In a large-scale head having a nozzle number of 10,000, if an opening and closing valve is provided for each nozzle, then there is a concern that production yield may decline. Hence, from the viewpoints of cost, manufacturing and production yield, it is not necessarily desirable to provide an opening and closing valve for each nozzle.

It is also possible to improve the invention described in Japanese Patent Application Publication No. 11-314376, by grouping together a certain number of nozzles (for example, 1000 nozzles) as one unit, and providing an opening and closing valve for each unit. Thereby, it is possible to reduce the number of opening and closing valves, and to remedy the aforementioned problems to a certain degree, but pressure variation occurs between units and this pressure variation causes adverse effects on image quality and hence this system is not practical.

SUMMARY OF THE INVENTION

The present invention has been contrived in view of the foregoing circumstances, an object thereof being to carry out individual suctioning at nozzles of an inkjet head, without providing opening and closing valves inside an inkjet head of a liquid ejection apparatus.

In order to attain the aforementioned object, the present invention is directed to a liquid ejection apparatus comprising: a liquid ejection head which comprises nozzles including at least one suctioned nozzle and at least one non-suctioned nozzle and ejecting liquid, pressure chambers supplying the nozzles with the liquid, and a common liquid chamber supplying the pressure chambers with the liquid; and an individual suctioning unit which suctions the liquid in the at least one suctioned nozzle, wherein when the individual suctioning unit suctions the liquid in the at least one suctioned nozzle, a following inequality is satisfied: $P0-\Delta Pin<Pn$, where Pn is an internal pressure of the at least one non-suctioned nozzle of which the liquid is not suctioned by the individual suctioning unit, and $P0-\Delta Pin$ is a first limit value of the internal pressure of the at least one non-suctioned nozzle above which air does not flow into the at least one non-suctioned nozzle.

In order to attain the aforementioned object, the present invention is also directed to a liquid ejection apparatus comprising: a liquid ejection head which comprises nozzles including at least one suctioned nozzle and at least one non-suctioned nozzle and ejecting liquid, pressure chambers supplying the nozzles with the liquid, and a common liquid chamber supplying the pressure chambers with the liquid; and an individual suctioning unit which suctions the liquid in the at least one suctioned nozzle, wherein when the individual suctioning unit suctions the liquid in the at least one suctioned nozzle, a following inequality is satisfied: $P0-\Delta Pin<Pn<P0+\Delta Pout$, where Pn is an internal pressure of the at least one non-suctioned nozzle of which the liquid is not suctioned by the individual suctioning unit, $P0-\Delta Pin$ is a first limit value of the internal pressure of the at least one non-suctioned nozzle above which air dose not flow into the at least one non-suctioned nozzle, and $P0+\Delta Pout$ is a second limit value of the internal pressure of the at least one non-suctioned nozzle below which the liquid dose not drip from the at least one non-suctioned nozzle.

When the individual suctioning unit suctions the liquid in the at least one suctioned nozzle, a following inequality may be satisfied: $P0+\Delta Pout<Pn$, where Pn is the internal pressure of the at least one non-suctioned nozzle, and $P0+\Delta Pout$ is a second limit value of the internal pressure of the at least one non-suctioned nozzle below which the liquid does not drip from the at least one non-suctioned nozzle.

Preferably, the liquid ejection apparatus further comprises filters each of which includes holes having a diameter smaller than a diameter of the nozzles, and which are disposed at positions between the common liquid chamber and the pressure chambers, positions in the pressure chambers, or positions between the pressure chambers and the nozzles.

Preferably, the liquid in the common liquid chamber is pressurized when the individual suctioning unit suctions the liquid in the at least one suctioned nozzle.

Preferably, the liquid ejection apparatus further comprises: an ink tank which supplies the common liquid chamber with the liquid; an ink supply flow channel which connects the ink tank with the common liquid chamber; and a flow channel adjusting mechanism which is provided in the ink supply flow channel and adjusts a flow channel resistance to a flow of the liquid in the ink supply flow channel so as to be substantially inversely proportional to number of the at least one suctioned nozzle.

Preferably, when the individual suctioning unit suctions the liquid in the at least one suctioned nozzle, the liquid ejection head is tilted from a horizontal position in such a manner that one end of the liquid ejection head to which an ink supply flow channel supplying the common liquid chamber with the liquid is connected is situated higher than another end of the liquid ejection head.

In order to attain the aforementioned object, the present invention is also directed to an image forming apparatus comprising any one of the liquid ejection apparatuses mentioned above.

As described above, according to the present invention, it is possible to perform individual suctioning of nozzles of an inkjet head in a liquid ejection apparatus, without providing opening and closing valves inside the inkjet head, and therefore beneficial effects are obtained in that it is possible to reduce costs, simplify the manufacturing process, and improve production yield, compared with an inkjet head in the related art which carries out individual suctioning.

BRIEF DESCRIPTION OF THE DRAWINGS

The nature of this invention, as well as other objects and benefits thereof, will be explained in the following with reference to the accompanying drawings, in which like reference characters designate the same or similar parts throughout the figures and wherein.

DETAILED DESCRIPTION OF THE PREFERRED EMBODIMENTS

General Composition of Inkjet Recording Apparatus

Figure 1:
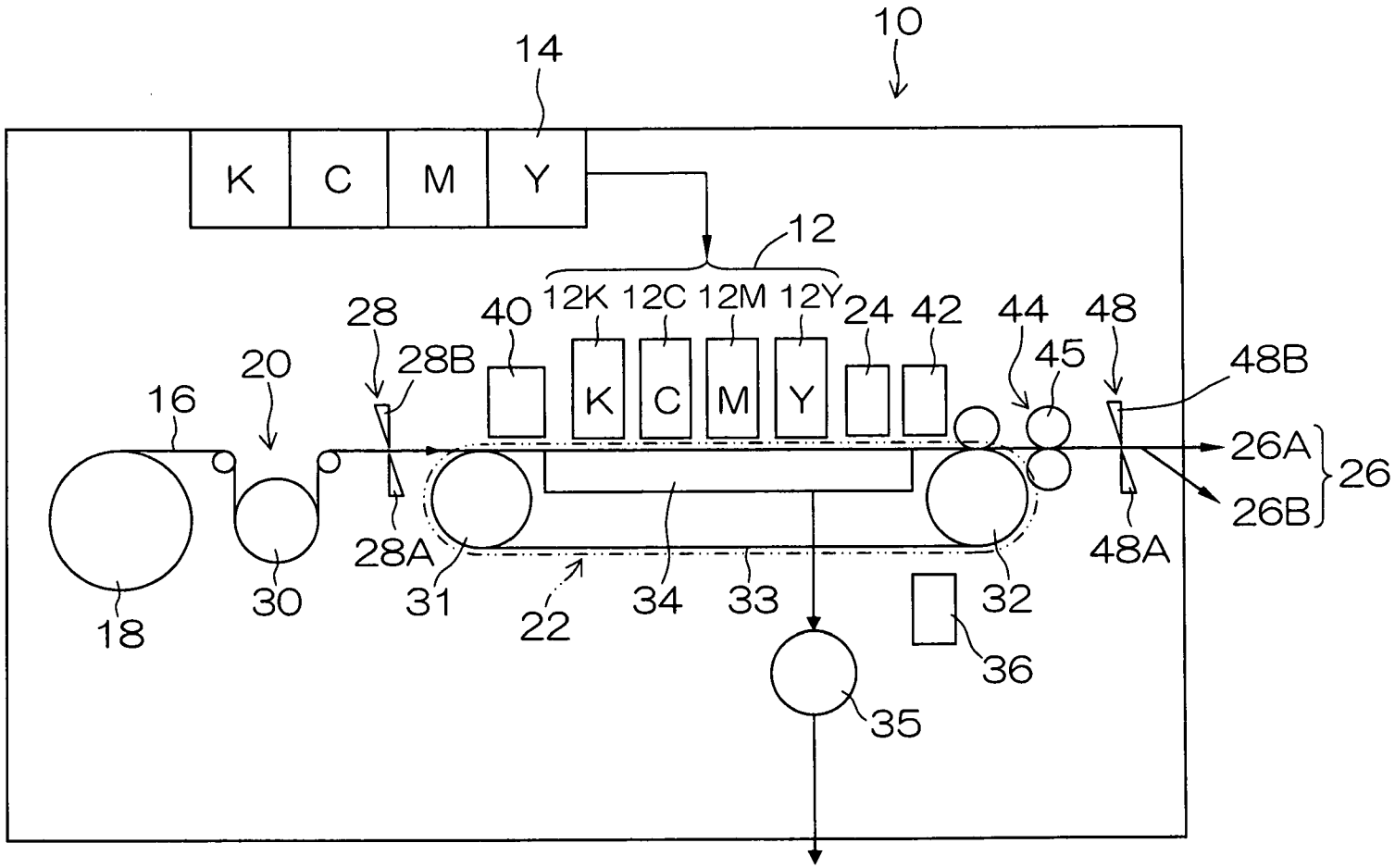
FIG. 1 is a general schematic drawing of an image forming apparatus according to an embodiment of the present invention.

FIG. 1 is a general schematic drawing showing an embodiment of an inkjet recording apparatus forming an image forming apparatus according to an embodiment of the present invention. As shown in FIG. 1, the inkjet recording apparatus 10 includes: a printing unit 12 having a plurality of liquid ejection heads (simply called "heads" in places hereinafter) 12K, 12C, 12M, and 12Y, provided for ink colors of black (K), cyan (C), magenta (M), and yellow (Y), respectively; an ink storing and loading unit 14 for storing inks of K, C, M, and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle faces (ink-droplet ejection faces) of the heads 12K, 12C, 12M, and 12Y, for conveying the recording paper 16 (recording medium) while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper be attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the head 12K, 12C, 12M, and 12Y and the sensor face of the print determination unit 24 forms a plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction. The belt 33 is driven in the clockwise direction in FIG. 1 by the motive force of a motor 88 (not shown in FIG. 1, but shown in FIG. 6) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration of nipping a brush roller and a water absorbent roller, an air blow configuration in which clean air is blown, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, instead of the suction belt conveyance unit 22. However, there is a drawback in the roller nip conveyance mechanism in that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
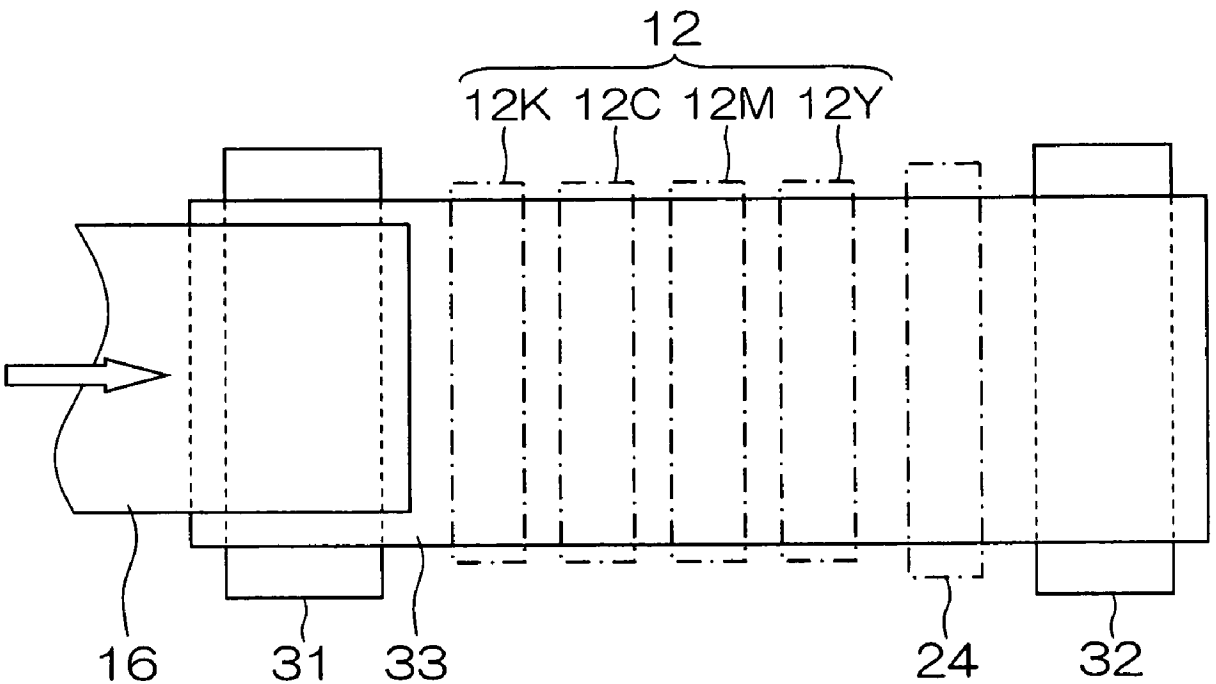
FIG. 2 is a principal plan diagram of the peripheral area of a print unit in the image forming apparatus shown in FIG. 1.

FIG. 2 is a principal plan diagram showing the periphery of the print unit 12 in the inkjet recording apparatus 10.

As shown in FIG. 2, the print unit 12 is a so-called "full line head" in which a line head having a length corresponding to the maximum paper width is arranged in a direction (main scanning direction) that is perpendicular to the paper feed direction (sub-scanning direction). Each of the print heads 12K, 12C, 12M, and 12Y constituting the print unit 12 is constituted by a line head, in which a plurality of ink ejection ports (nozzles) are arranged along a length that exceeds at least one side of the maximum-size recording paper 16 intended for use in the inkjet recording apparatus 10.

The heads 12K, 12C, 12M, and 12Y are arranged in the order of black (K), cyan (C), magenta (M), and yellow (Y) from the upstream side (left side in FIG. 1), along the conveyance direction of the recording paper 16. A color image can be formed on the recording paper 16 by ejecting the inks from the heads 12K, 12C, 12M, and 12Y, respectively, while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper feeding direction just once (in other words, by means of a single sub-scan). Higher-speed printing is thereby made possible and productivity can be improved in comparison with a shuttle type head configuration in which a head moves reciprocally in the main scanning direction that is perpendicular to the paper feed direction.

Although a configuration with four standard colors, K, C, M, and Y, is described in the present embodiment, the combinations of the ink colors and the number of colors are not limited to these, and light and/or dark inks can be added as required. For example, a configuration is possible in which heads for ejecting light-colored inks such as light cyan and light magenta are added.

As shown in FIG. 1, the ink storing and loading unit 14 has ink tanks for storing the inks of the colors corresponding to the respective heads 12K, 12C, 12M, and 12Y, and the respective tanks are connected to the heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

A test pattern printed by the print heads 12K, 12C, 12M, and 12Y of the respective colors is read in by the print determination unit 24, and the ejection performed by each head is determined. The ejection determination includes detection of the ejection, measurement of the dot size, measurement of the dot formation position, and the like.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming into contact with ozone and other substances that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in the drawings, the paper output unit 26A for the target prints is provided with a sorter for collecting prints according to print orders.

Composition of Liquid Ejection Head

Next, the structure of a head is described below. The heads 12K, 12C, 12M, and 12Y of the respective ink colors have the same structure, and a reference numeral 50 is hereinafter designated to any of the heads.

Figure 3A:
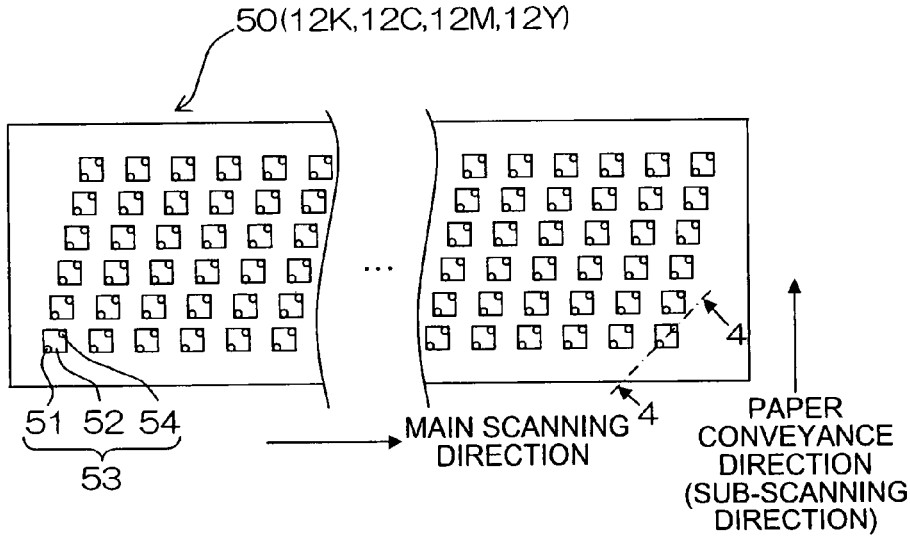
FIGS. 3A to 3C are plan view perspective diagrams showing examples of the composition of a liquid ejection head.
Figure 3B:
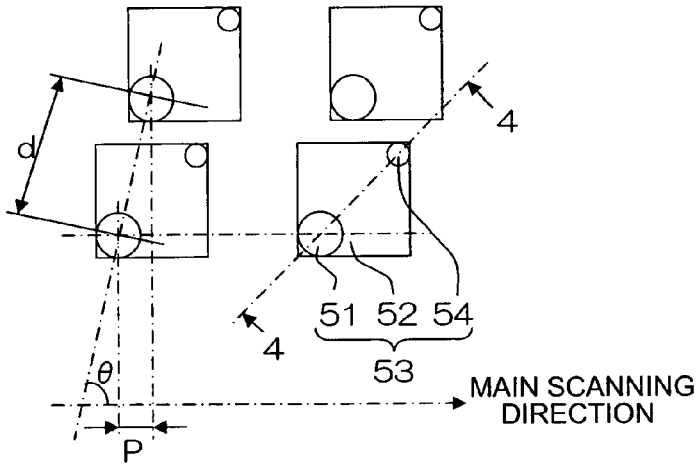
Figure 3C:
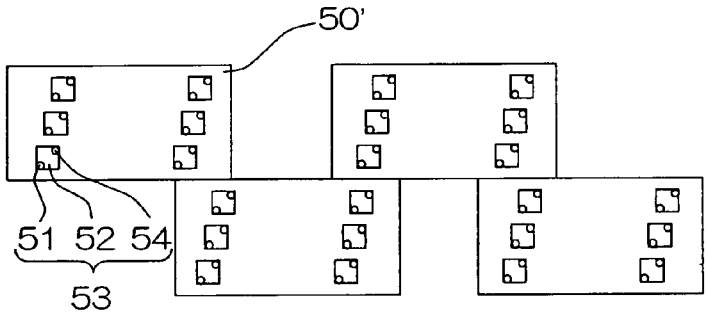

FIG. 3A is a perspective plan view showing an example of the configuration of the head 50, FIG. 3B is an enlarged view of a portion thereof, and FIG. 3C is a perspective plan view showing another example of the configuration of the head 50.

The nozzle pitch in the head 50 should be minimized in order to maximize the density of the dots printed on the surface of the recording paper 16. As shown in FIGS. 3A to 3C, the head 50 according to the present embodiment has a structure in which a plurality of ink chamber units 53, each comprising a nozzle 51 forming an ink droplet ejection port, a pressure chamber (liquid chamber) 52 and a supply port 54 corresponding to the nozzle 51, and the like, are disposed two-dimensionally in the form of a staggered matrix. Hence, the effective nozzle interval (the projected nozzle pitch) as projected in the lengthwise direction of the head (the main scanning direction that is perpendicular to the paper conveyance direction) is reduced and high nozzle density is achieved.

The mode of forming one or more nozzle rows through a length corresponding to the entire width of the recording paper 16 in a main scanning direction substantially perpendicular to the paper conveyance direction is not limited to the example described above. For example, instead of the configuration in FIG. 3A, as shown in FIG. 3C, a line head having nozzle rows of a length corresponding to the entire width of the recording paper 16 can be formed by arranging and combining, in a staggered matrix, short head blocks 50' having a plurality of nozzles 51 arrayed in a two-dimensional fashion.

The present embodiment describes a mode in which the planar shape of the pressure chambers 52 is substantially a square shape, but the planar shape of the pressure chambers 52 is not limited to being a substantially square shape, and it is possible to adopt various other shapes, such as a substantially circular shape, a substantially elliptical shape, a substantially parallelogram (diamond) shape, or the like. Furthermore, the arrangement of the nozzles 51 and the supply ports 54 is not limited to the arrangement shown in FIGS. 3A to 3C, and it is also possible to arrange nozzles 51 substantially in the central region of the pressure chambers 52, or to arrange the supply ports 54 in the side walls of the pressure chambers 52.

As shown in FIG. 3B, the high-density nozzle head according to the present embodiment is achieved by arranging a plurality of ink chamber units in a lattice fashion based on a fixed arrangement pattern, in a row direction which coincides with the main scanning direction, and a column direction which is inclined at a fixed angle of θ with respect to the main scanning direction, rather than being perpendicular to the main scanning direction.

More specifically, by adopting a structure in which a plurality of ink chamber units 53 are arranged at a uniform pitch d in line with a direction forming an angle of θ with respect to the main scanning direction, the pitch P of the nozzles projected so as to align in the main scanning direction is $d \times \cos\theta$, and hence the nozzles 51 can be regarded to be equivalent to those arranged linearly at a fixed pitch P in the main scanning direction. Such configuration results in a nozzle structure in which the nozzle row projected in the main scanning direction has a high nozzle density of up to 2,400 nozzles per inch.

When implementing the present embodiment, the arrangement structure of the nozzles is not limited to the example shown in the drawings, and it is also possible to apply various other types of nozzle arrangements, such as an arrangement structure having one nozzle row in the sub-scanning direction, a structure having nozzle rows arranged in a two-row staggered configuration, and the like.

In a full-line head including rows of nozzles that have a length corresponding to the entire width of the image recordable width, the "main scanning" is defined as printing one line (a line formed of a row of dots, or a line formed of a plurality of rows of dots) in the width direction (main-scanning direction) of the recording medium by driving the nozzles in one of the following ways: (1) simultaneously driving all the nozzles; (2) sequentially driving the nozzles from one side toward the other; and (3) dividing the nozzles into blocks and sequentially driving the nozzles from one side toward the other in each of the blocks.

In particular, when the nozzles 51 arranged in a matrix such as that shown in FIGS. 3A to 3C are driven, the main scanning according to the above-described (3) is preferred.

On the other hand, "sub-scanning" is defined as to repeatedly perform printing of one line (a line formed of a row of dots, or a line formed of a plurality of rows of dots) formed by the main scanning, while moving the full-line head and the recording paper 16 relatively to each other.

In the present embodiment, a full line head is described, but the scope of application of the present invention is not limited to this and it can also be applied to a serial type of head which carries out printing in the breadthways direction of the recording paper 16 while scanning a short head having nozzle rows of a length shorter than the width of the recording paper 16, in the breadthways direction of the recording paper 16.

As shown in FIGS. 3A to 3C, the pressure chamber 52 provided corresponding to each of the nozzles 51 is approximately square-shaped in plan view. The nozzle 51 formed in the nozzle substrate 59, and a supply port 54, are provided respectively at either corner of a diagonal of the pressure chamber 52. The pressure chambers 52 are connected to a common flow channel (common liquid chamber), which is not illustrated, via the supply ports shown in FIGS. 3A and 3B. The common flow channel is connected to an ink supply tank which is not shown in the drawings, and the ink supplied from the ink supply tank is distributed and supplied to the pressure chambers 52 via the common flow channel.

Structure of Liquid Ejection Head

Figure 4:
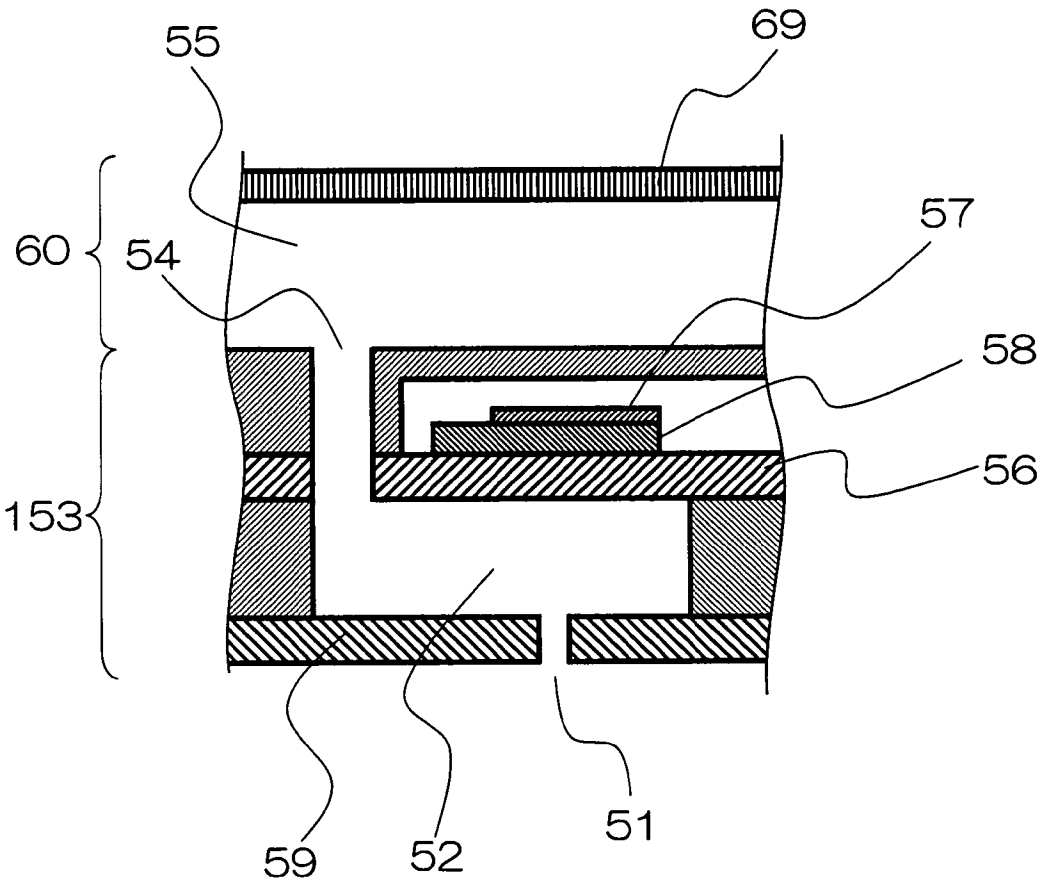
FIG. 4 is a cross-sectional diagram of a liquid ejection head.

Next, the detailed structure of the liquid ejection head is described with reference to FIG. 4. FIG. 4 is a cross-sectional diagram (a cross-sectional diagram along a line 4-4 in FIGS. 3A and 3B) of a region corresponding to one ejector in a liquid ejection head.

As shown in FIG. 4, the liquid ejection head is constituted by an ejector layer 153 and a common liquid chamber layer 60. The common liquid chamber layer 60 has a common liquid chamber 55 which serves as a common flow channel for supplying ink to the ejector layer 153. The common liquid chamber 55 is defined by the ejector layer 153 and a wall 69, and ink flows inside the common liquid chamber 55. The ejector layer 153 has pressure chambers 52, and the ejector layer 153 (the pressure chambers 52) is connected to the common liquid chamber 55 which supplies ink via supply ports 54. Each pressure chamber 52 serves as an individual liquid chamber connected to a nozzle 51 for ejecting ink. One surface (in FIG. 4, the ceiling) of each pressure chamber 52 is constituted by a diaphragm 56, and piezoelectric elements 58 which cause the diaphragm 56 to deform are bonded on top of the diaphragm 56. An individual electrode 57 is formed on the upper surface of each piezoelectric element 58, and the diaphragm 56 also serves as a common electrode. The nozzles 51 are constituted by holes provided in the nozzle plate 59.

Each piezoelectric element 58 is interposed between the common electrode (diaphragm 56) and the individual electrode 57. The piezoelectric element 58 deforms when a drive voltage is applied between the common electrode (diaphragm 56) and the individual electrode 57. A structure is adopted in which the diaphragm 56 deforms due to the deformation of the piezoelectric element 58, thereby reducing the volume of the pressure chamber 52 and applying pressure to the ink inside the pressure chamber 52, and accordingly, the ink is ejected from the nozzle 51. When the voltage applied between the common electrode (diaphragm 56) and the individual electrode 57 is released, the piezoelectric element 58 returns to its original position, the volume of the pressure chamber 52 returns to its original size, and new ink is supplied into the pressure chamber 52 from the common liquid chamber 55 via the supply port 54.

Ejection Restoration Mechanism

Principles of the present embodiment are described in explaining suctioning with regard to a liquid ejection apparatus according to the present embodiment.

Figure 5:
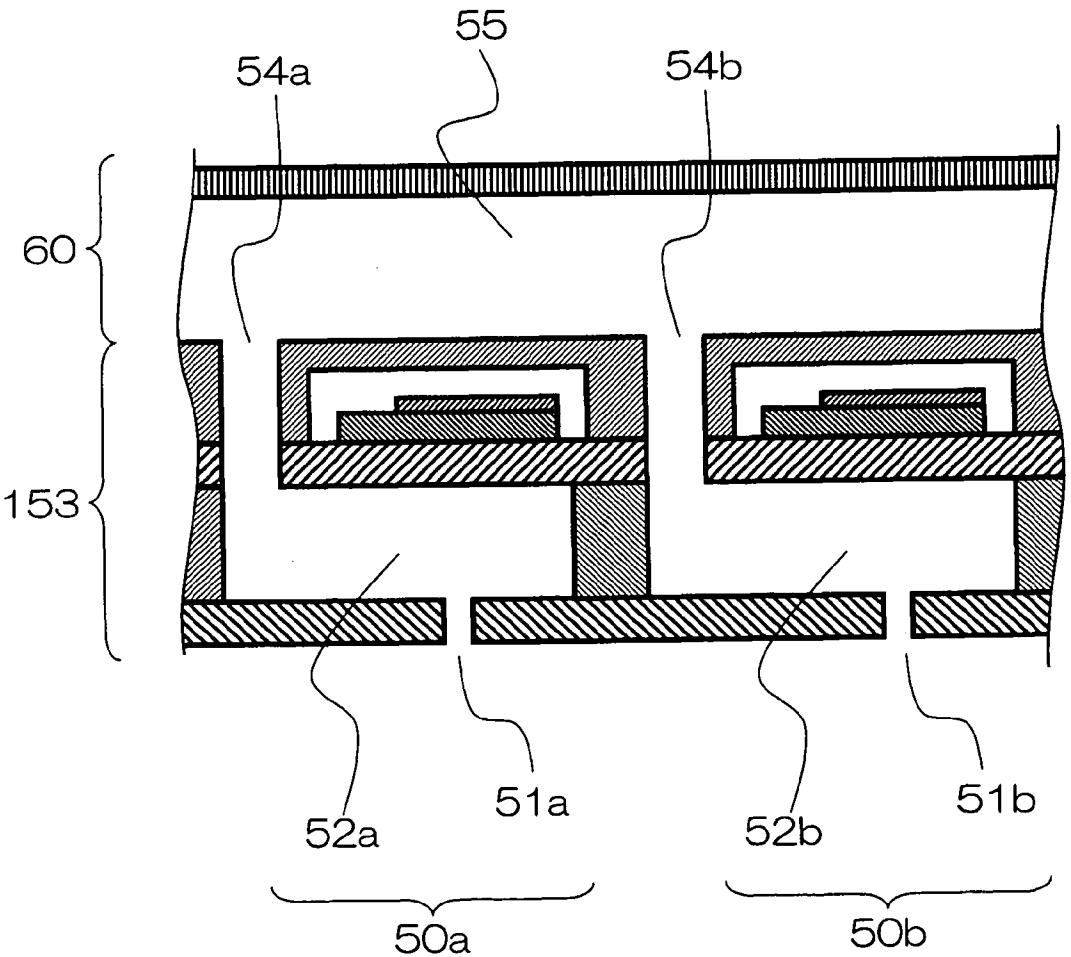
FIG. 5 is a cross-sectional diagram of a liquid ejection head for illustrating an embodiment of the present invention.
Figure 6A:
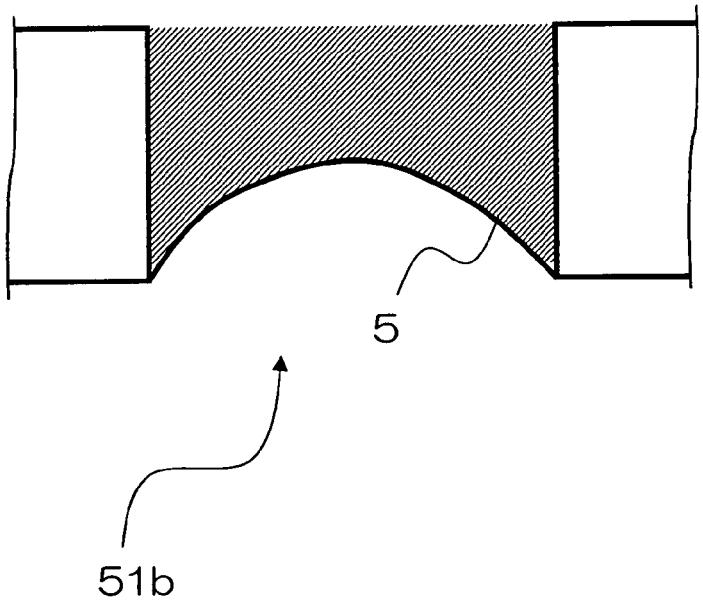
FIGS. 6A and 6B are cross-sectional diagrams of the vicinity of a nozzle.

FIG. 5 is a diagram showing an ejector 50*a* for which individual suctioning is carried out and an ejector 50*b* for which individual suctioning is not carried out. When individual suctioning of the ink is carried for the ejector 50*a*, then a force (negative pressure) acts, in the nozzle (the suctioned nozzle) 51*a* being suctioned, so as to pull the liquid in the liquid ejection direction, thereby suctioning the ink. Ink is thus suctioned from the suctioned nozzle 51*a*, and therefore the negative force acts so as to pull the liquid from the common liquid chamber 55, via the pressure chamber 52*a* and the supply port 54*a*. This negative force also has an effect on the nozzle ("non-suctioned nozzle") 51*b* which is not being suctioned in the ejector 50*b* for which individual suctioning is not being carried out. More specifically, the force acts so as to draw ink from the pressure chamber 52*b* connected to the non-suctioned nozzle 51*b*, toward the common liquid chamber 55 via the supply port 54*b*, and the force also draws ink from the nozzle 51*b* toward the pressure chamber 52*b*. As a result of this negative force, as shown in FIG. 6A, the meniscus surface (the surface of the liquid inside the nozzle 51*b* whose curvature is created by surface tension of the liquid) 5 in the nozzle 51*b* is withdrawn. If this negative force is stronger, then the meniscus surface 5 is withdrawn further, and ultimately, an air bubble enters into the nozzle 51*b*.

When an air bubble enters into the nozzle 51*b*, material, such as dirt and dust, floating in the vicinity of the nozzle 51*b* also may enter into the nozzle 51*b* and the pressure chamber 52*b* together with the air. Accordingly, an ejection defect occurs in the nozzle 51*b*.

Figure 6B:
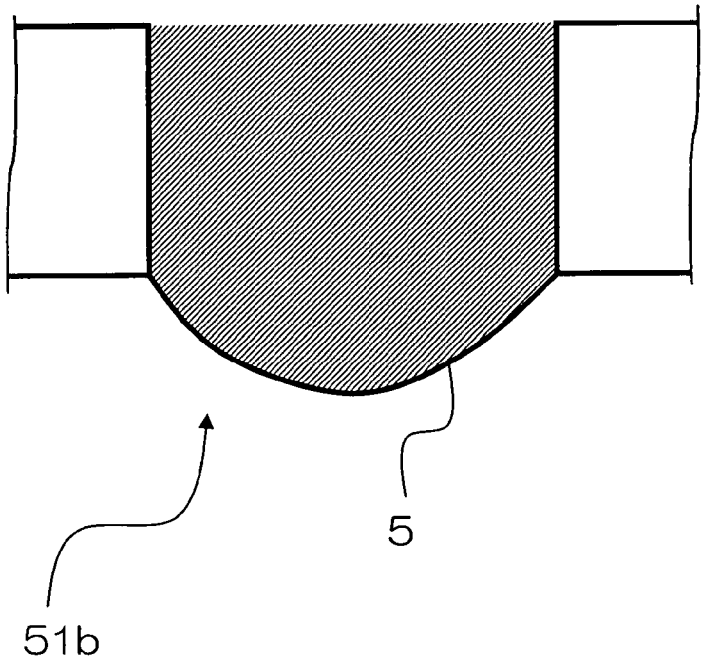

The reverse case is described below where the ink in the common liquid chamber 55 is in a pressurized state. In this case, in the ejector 50*b* for which individual suctioning is not being carried out, a force acts so as to push ink from the common liquid chamber 55 to the pressure chamber 52*b* via the supply port 54*b*, and furthermore, this force also pushes ink from the pressure chamber 52*b* to the nozzle 51*b*. Accordingly, as shown in FIG. 6B, the meniscus surface 5 in the nozzle 51*b* is caused to advance (the meniscus surface protrudes from the nozzle 51*b*). If this force is stronger, then the meniscus surface 5 is advanced further, and ultimately, ink drips from the nozzle 51 in the form of an ink droplet. If the ink drips from the non-suctioned nozzle 51*b* in this way, then the ink does not actually contribute to image formation and the dropped ink is wasted ink, which is uneconomical. The relationship described above exists between nozzles 51. Moreover, the common liquid chamber 55 connected to the nozzles 51 is also connected to an ink tank described later, and hence the relationship also depends on the pressure in the ink tank.

Consequently, the pressure applied to the ink inside the nozzle 51*b* needs to be such that it does not cause air to enter into the nozzle 51*b*, or does not cause ink to drip from the nozzle in the form of a droplet.

More specifically, the limit pressure in the nozzle 51*b* to prevent air from entering into the nozzle 51*b* (in order to prevent reflux of air through the nozzle 51*b*), is P0−ΔPin. Here, P0 is the atmospheric pressure, and ΔPin is the limit pressure differential for preventing reflux of air via the nozzle 51*b*.

On the other hand, the limit pressure in the nozzle 51*b* to prevent ink from dripping from the nozzle 51, is P0+ΔPout. Here, P0 is the atmospheric pressure, and ΔPout is the limit pressure differential for preventing ink from dripping from the nozzle 51*b*.

Therefore, the pressure Pn in the nozzle 51*b* is required to satisfy the relationship:

$$P0-\Delta P\text{in} < Pn < P0+\Delta P\text{out}$$

Next, the liquid ejection apparatus according to the present embodiment is described below with reference to FIGS. 7 and 8A to 8C.

Figure 7:
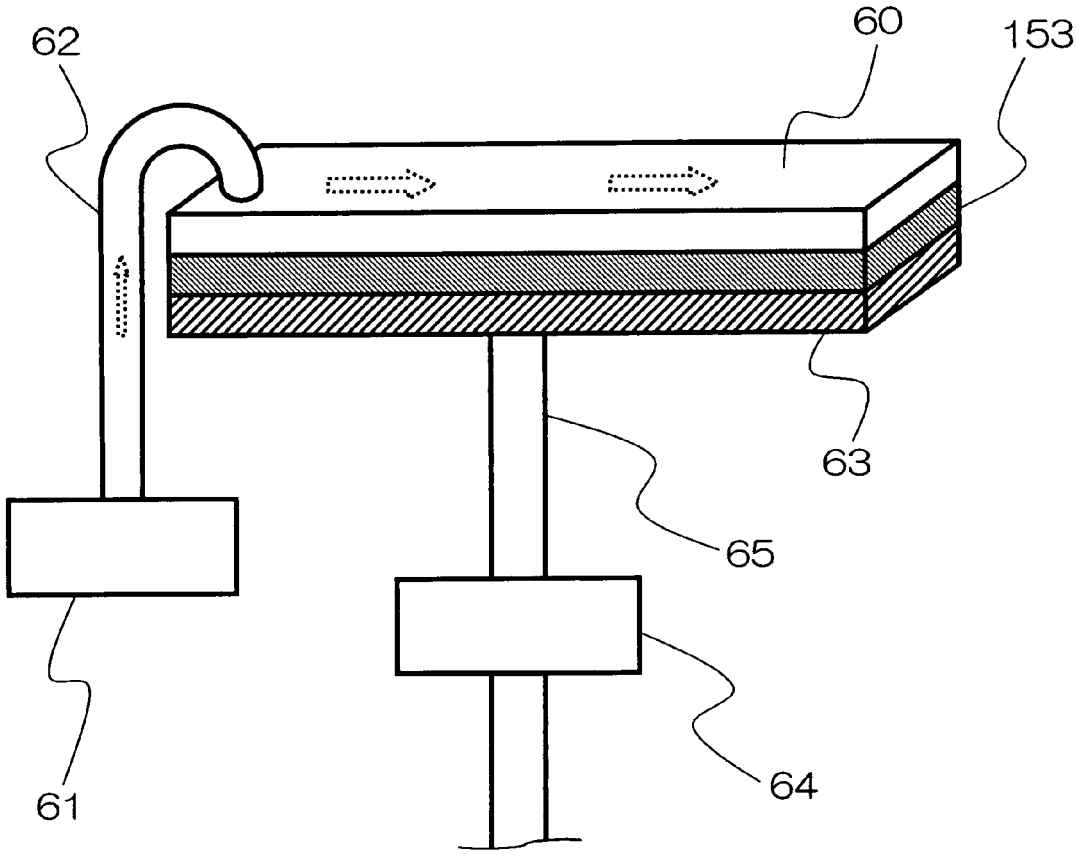
FIG. 7 is a perspective diagram of a liquid ejection apparatus according to a first embodiment of the present invention.

FIG. 7 is a diagram showing a perspective drawing of a liquid ejection apparatus according to the present embodiment. The liquid ejection apparatus according to the present embodiment has an ink tank 61, an ink supply channel 62, and a common liquid chamber 55. Ink flows along the ink supply channel 62 in the direction indicated by the arrow, and ink is thus supplied to the common liquid chamber 55 inside the common liquid chamber layer 60. The ink supplied to the common liquid chamber 55 flows further in the direction indicated by the arrow and is then supplied to the pressure chambers 52 inside the injector layer 153.

Ink suctioning is carried out by placing a cap member 63 in close contact with the nozzle 51 surface of the liquid ejection head, and performing individual suctioning of nozzles 51 in a prescribed region by means of the suction pump 64 via an ink suctioning channel 65 connected to the cap member 63.

Figure 8A:
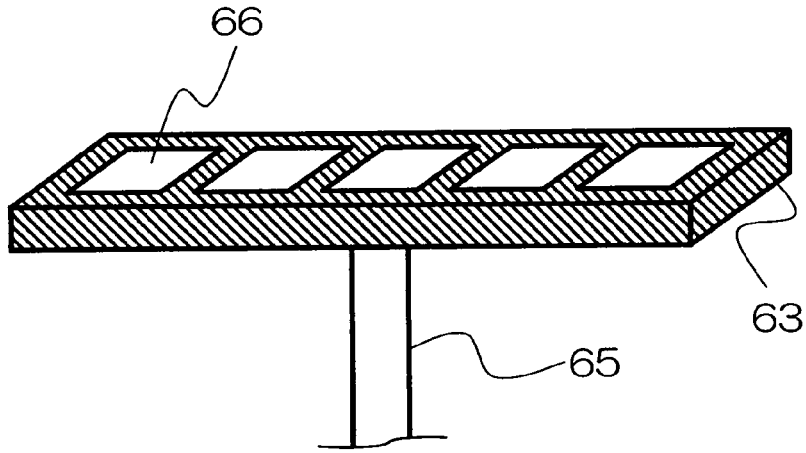
FIGS. 8A to 8C are general schematic diagrams showing a cap member according to the first embodiment of the present invention.
Figure 8B:
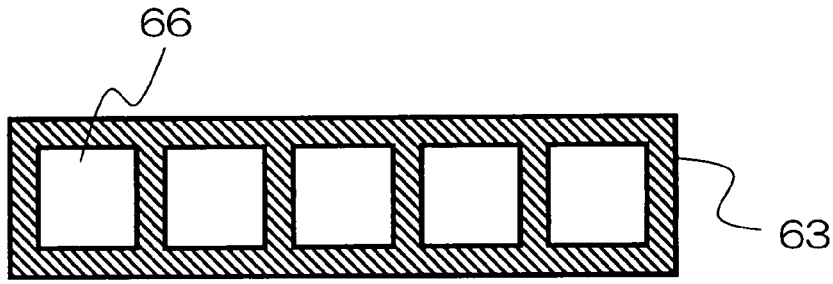
Figure 8C:
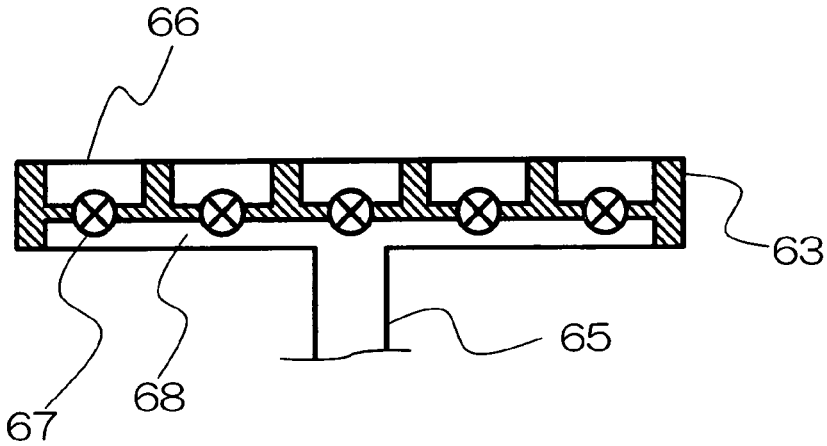

FIGS. 8A to 8C are diagrams showing the structure of the cap member 63. FIG. 8A is a perspective diagram of the cap member 63, FIG. 8B is a plan diagram of same, and FIG. 8C is a cross-sectional diagram of it.

The cap member 63 includes individual suctioning sections 66 in such a manner that individual suctioning can be carried out for each area. When the cap member 63 is placed in close contact with the ejector layer 153, the suctioning is carried out for an individual suctioning section 66 which requires to be suctioned. More specifically, in cases where there is a nozzle 51 which requires suctioning in the region covered by an individual suctioning section 66, in other words, in cases where there is an ejection abnormality nozzle in the region covered by an individual suctioning section 66, suctioning is carried out for that individual suctioning section 66. On the other hand, if there is no nozzle 51 which requires suctioning in a region covered by an individual suctioning section 66, then suctioning is not carried out for that individual suctioning section 66. In this case, a valve 67 provided for the individual suctioning section 66 remains in a closed state, and therefore the individual suctioning section 66 is not at a negative pressure. An ejection abnormality nozzle is detected by means of the print determination unit 24 shown in FIG. 1 and an ejection failure determination mechanism (not shown) provided for each nozzle 51, and the like. When individual suctioning is to be carried out with respect to one individual suctioning section 66, the valve 67 corresponding to that individual suctioning section 66 is opened, thereby setting the interior of the individual suctioning section 66 to a negative pressure. By setting the interior of one individual suctioning section 66 to a negative pressure, the ink is suctioned from the nozzles 51 existing in the area corresponding to that individual suctioning section 66 that is set to a negative pressure. The ink suctioned from the nozzles 51 is further suctioned through the ink suctioning channel 65, via a common suctioning unit 68.

Next, the overall flow channel resistance of the liquid ejection head in the liquid ejection apparatus described above with reference to FIGS. 7 and 8A to 8C, is described with reference to FIG. 9.

Figure 9:
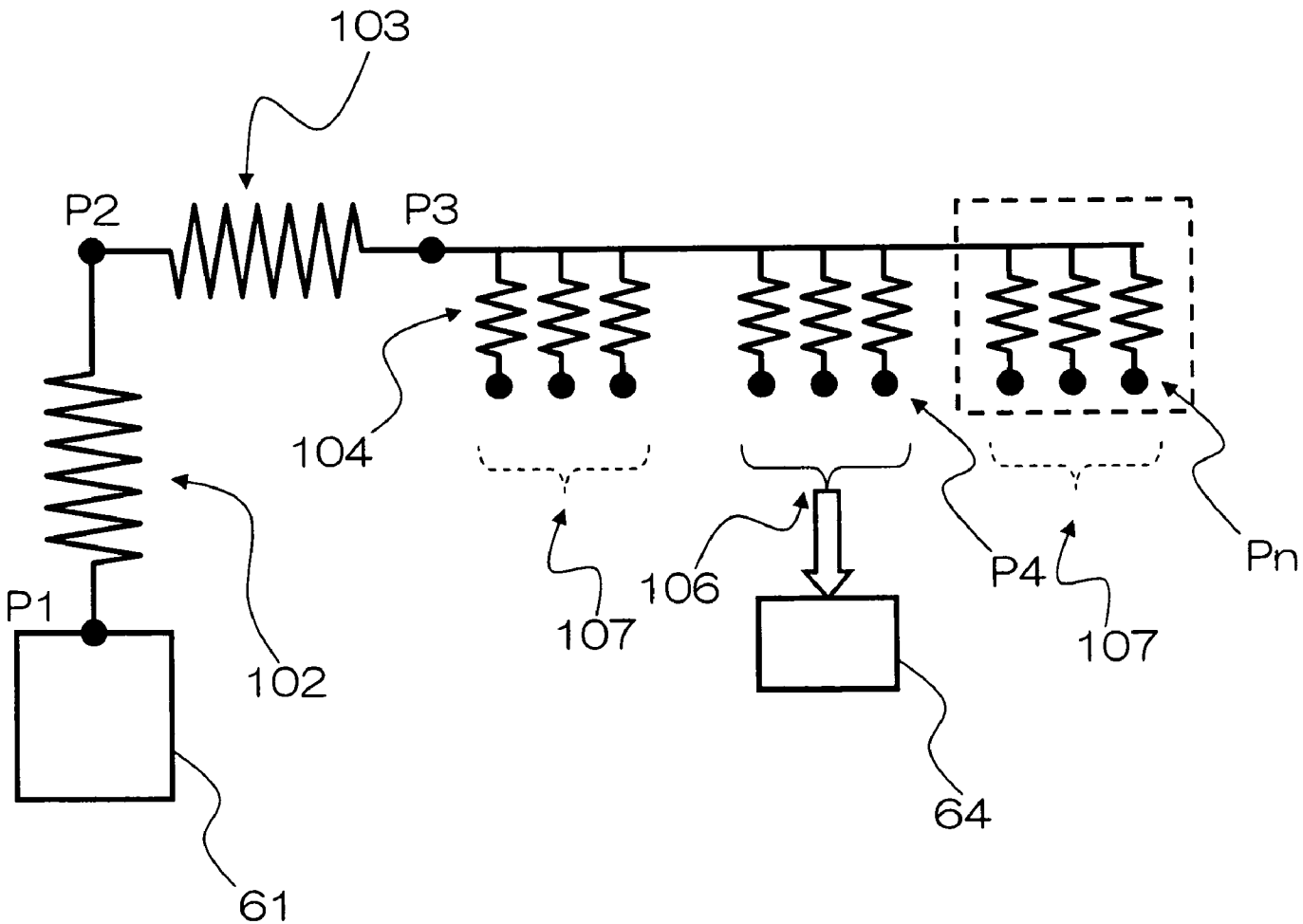
FIG. 9 is an acoustic circuit diagram of a liquid ejection apparatus.

FIG. 9 is a diagram showing all of the flow channels in the liquid ejection head. In FIG. 9, the flow channels are denoted in the form of acoustic circuits.

Figure 10:
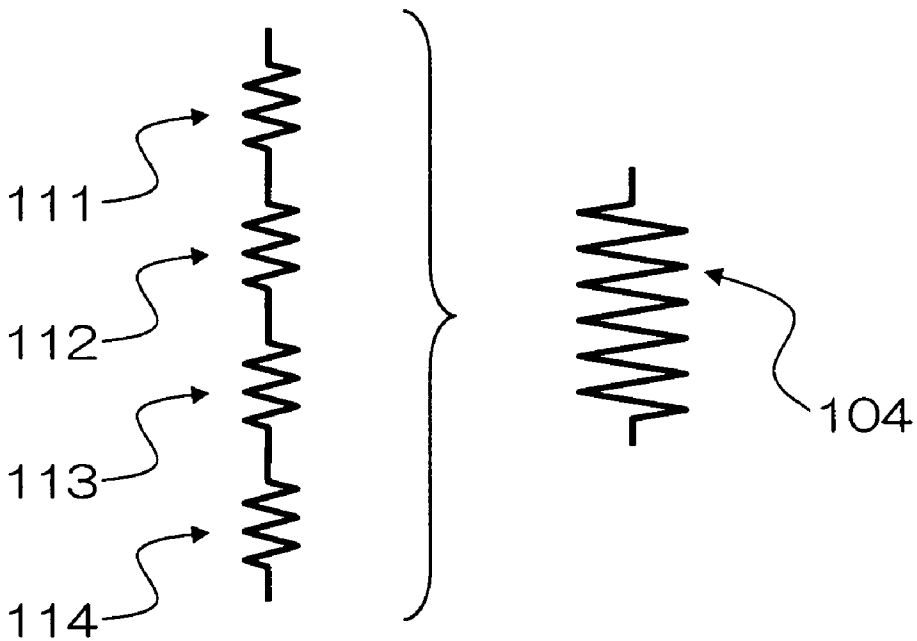
FIG. 10 is an acoustic circuit diagram of an ejector section.

Ink is supplied from the ink tank 61 to the common liquid chamber 55, via the ink supply channel 62. There exists an ink flow channel resistance (referred to as the ink supply channel resistance 102) between the ink tank 61 and the common liquid chamber 55. Due to this ink supply channel resistance 102, the pressure P1 of the ink in the ink tank 61 changes to P2. Moreover, there is a common liquid chamber resistance 103 inside the common liquid chamber 55. Due to this common liquid chamber resistance 103, the pressure value P2 of the ink at the outlet of the ink supply channel 62, that is to say, at the inlet to the common liquid chamber 55, changes to P3. Subsequently, the ink is supplied to the ejector layer 153, and in this case, there are ejector resistances 104 which is a flow channel resistance in the ejector layer 153. As shown in FIG. 10, each ejector resistance 104 includes: a resistance 111 in an individual filter, which is provided if necessary; a resistance 112 in the ink supply port 54; a resistance 113 in the pressure chamber 52; and a resistance 114 in the connecting channel connected to the nozzle 51 and the nozzle 51 itself, and the like.

The overall flow channel resistance of the liquid ejection head is dependent on the number of suctioned nozzles 106. In other words, the following relationship is satisfied:

"overall flow channel resistance in liquid ejection head"∝(1/"number of suctioned nozzles").

Therefore, the following relationship is satisfied:

"overall volume velocity (flow rate) of liquid ejection head"∝"number of suctioned nozzles".

This is because pressure loss in the ink supply channel is obtained from the product of the flow channel resistance and the overall flow rate in liquid ejection head.

In this case, the pressure loss in the ink supply channel is expressed as follows:

"pressure loss in ink supply channel"="flow channel resistance in ink supply channel"×"overall flow rate of liquid ejection head"

Consequently, the following relationship is satisfied:

"pressure loss in ink supply channel"∝"number of suctioned nozzles".

When individual suctioning is performed, the suctioned nozzles 106 are suctioned by the suction pump 64. During this individual suctioning, the pressure in the suctioned nozzles 106 has a value of P4. Since this individual suctioning is affected by the ejector resistance 104, then the pressure at the outlet of the common liquid chamber 55 has a value of P3. The ink pressure in the nozzle tips of the non-suctioned nozzles 107 has a value of Pn.

The length of ink passage (along which ink flows from the inlet of the common liquid chamber into each pressure chamber unit) depends on the location of each ejector (each nozzle). Hence, the ink pressure at the outlet of the common liquid chamber has a value of P3 to P2. Since the pressure is uniform in region where there is no liquid flow (Pascal's principle), then the pressure value Pn of the ink at the nozzle tip of the non-suctioned nozzle comes within the range from P3 to P2. In other words, the following expression is obtained:

$$P3 \leqq Pn \leqq P2$$

The pressure Pn has a lower limit of P3 and an upper limit of P2.

Figure 11:
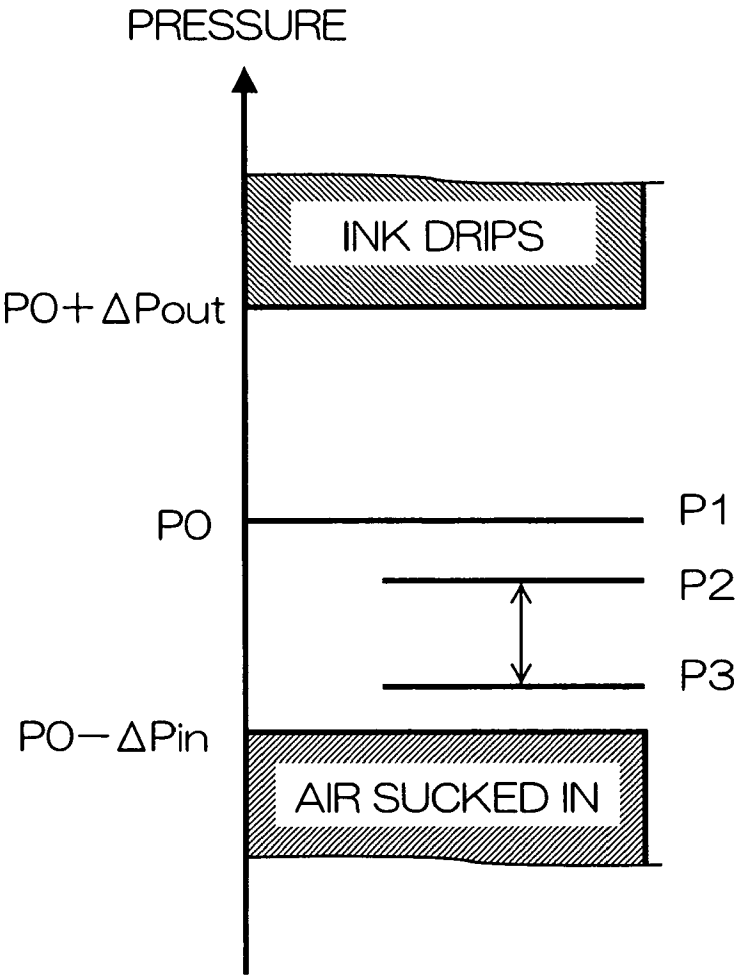
FIG. 11 is a diagram of pressure relationships.

In the present embodiment, pressure is not applied to the ink tank 61, and therefore the pressures P0 to P3 have the relationship shown in FIG. 11. More specifically, the pressure value P1 of the ink in the ink tank is the same as the atmospheric pressure P0, because no pressure is applied to the ink tank 61. When ink suctioning is carried out at the suctioned nozzle 106, then the pressure values P2 and P3 decline as shown in FIG. 11, because of the ink supply channel resistance 102 and the common liquid resistance 103. Since the value Pn has a value between P2 and P3 (the smallest value of Pn is P3), then the reflux of air can be prevented only if the pressure P3 has a value greater than "P0−ΔPin".

WORKING EXAMPLES

Next, working examples of the present embodiment are described on the basis of specific numerical values. The values of the flow channel resistances are shown in FIG. 12.

In a working example of the present embodiment, the ejector layer 153 includes the nozzles 51, and the number of nozzles 51 is 15600. The nozzles 51 are divided into nozzle groups each including 200 nozzles, and the individual suctioning sections 66 in the cap member 63 are formed in such a manner that each nozzle group can be suctioned individually. In the present working example, the number of individual suctioning sections 66 in the cap member 63 (the number of nozzle groups) is 78. The inkjet head according to the present working example has the following properties:

Ink viscosity is 10 cP;
Ink supply channel resistance 102 is $5.0\times10^{8}$ Ns/m$^5$;
Length of ink supply channel 62 is 100 mm;
Internal diameter of ink supply channel 62 is 3 mm;
Common liquid chamber resistance 103 is $7.4\times10^{7}$ Ns/m$^5$;
Width of common liquid chamber 55 is 20 mm;
Height of common liquid chamber 55 is 3 mm;
Length of common liquid chamber 55 is 300 mm;
Flow channel resistance 104 per ejector is $5.0\times10^{13}$ Ns/m$^5$.

Figure 12:
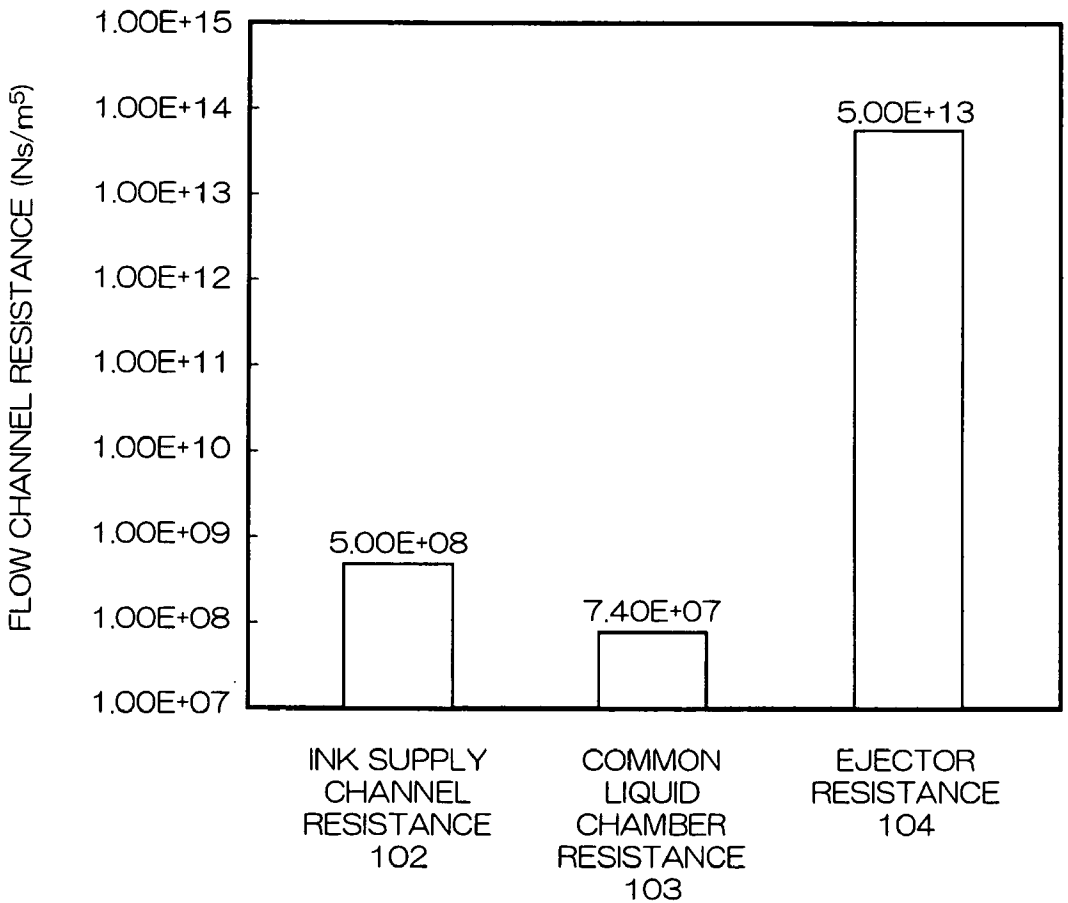
FIG. 12 is a comparative diagram for comparing flow channel resistances in a liquid ejection apparatus.

As shown in FIG. 12, the flow channel resistance 104 in one ejector is a relatively large value, compared to the ink supply channel resistance 102 or the common liquid chamber resistance 103. In this case, the flow channel resistance 104 shown above is the value per ejector; however, the flow channel resistance is larger than the common liquid chamber resistance 103 even in the light of the fact that the number of nozzles in the liquid ejection apparatus according to the present working example is 15600.

The flow channel resistance 104 per ejector is a value calculated when liquid droplets having a volume of 2 to 3 (pl) are ejected at an ejection frequency of 20 to 40 (kHz).

The common liquid chamber resistance 103 changes depending on the locations of the nozzles 51 which are being suctioned. In the present embodiment, for the purpose of the description, it is supposed that the value of the common liquid chamber resistance 103 has a maximum value. Since the common liquid chamber resistance 103 has a maximum value, then it can be seen from FIGS. 9 and 10 that this assumption is the most difficult condition for implementing the present embodiment.

Figure 13:
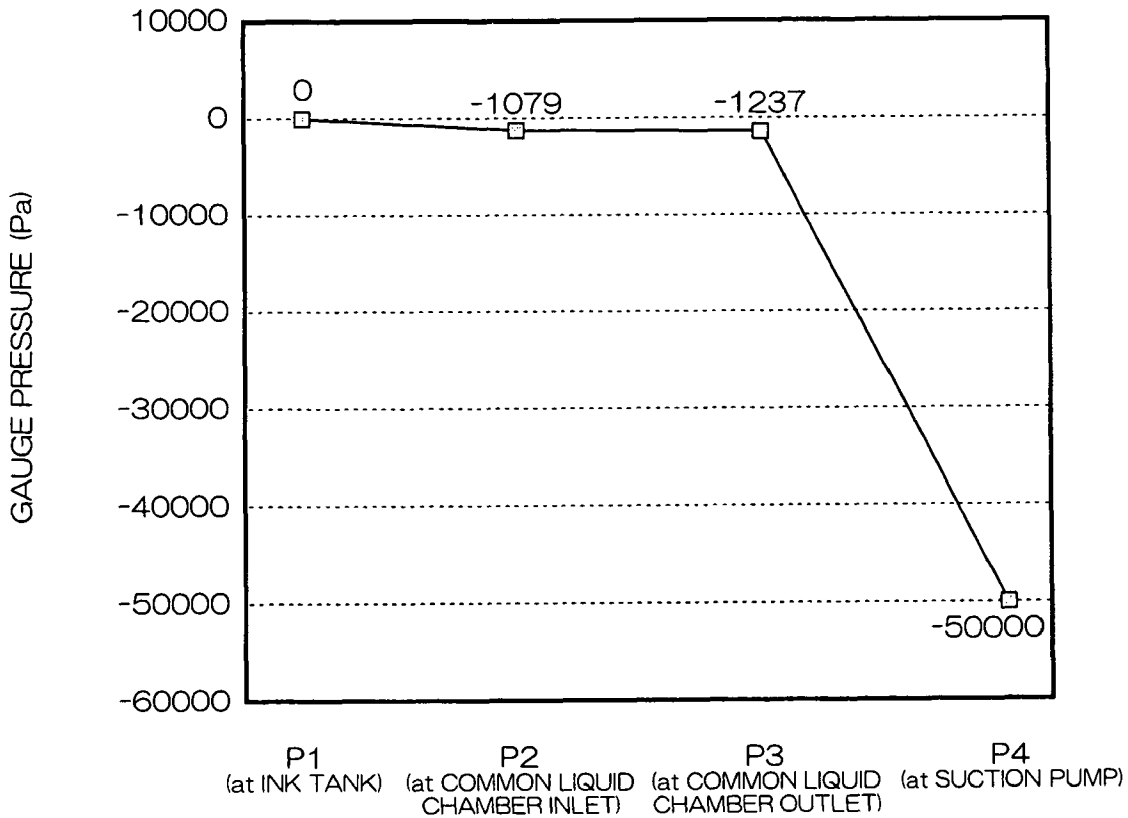
FIG. 13 is a pressure distribution diagram.

Next, the pressure values during suctioning of ink in a liquid ejection apparatus of this kind are described specifically, with reference to FIG. 13.

FIG. 13 is a diagram showing gauge pressure values when individual suctioning is carried out with the suction pump. The suctioning section is at a gauge pressure (relative pressure) of −50000 Pa. In this case, the number of individual suctioning sections 66 that are suctioned is assumed to be 11, and the nozzles corresponding to these eleven sections are suctioned simultaneously. In other words, 2200 nozzles are suctioned simultaneously.

As shown in FIG. 13, the value P1 of the gauge pressure (relative pressure) in the ink tank 61 is the same as the atmospheric pressure. In other words, the gauge pressure P1 has a value of 0 Pa. Since no pressure is applied, and the value P4 of the gauge pressure in the suctioned nozzles 106 where individual suctioning is being carried out is −50000 Pa, due to the suction pump 64 which is performing individual suctioning. On the basis of the flow channel resistance values described above, the pressure value P2 at the inlet of the common liquid chamber 55 has a value of −1079 Pa, and the pressure value P3 at the outlet of the common liquid chamber 55 has a value of −1237 Pa. In the present embodiment, ΔPin has a value of 3000 Pa, and therefore, there is no reflux of ink from the nozzles 51 and air does not enter into the pressure chambers 52.

Explanation on Control System

Figure 14:
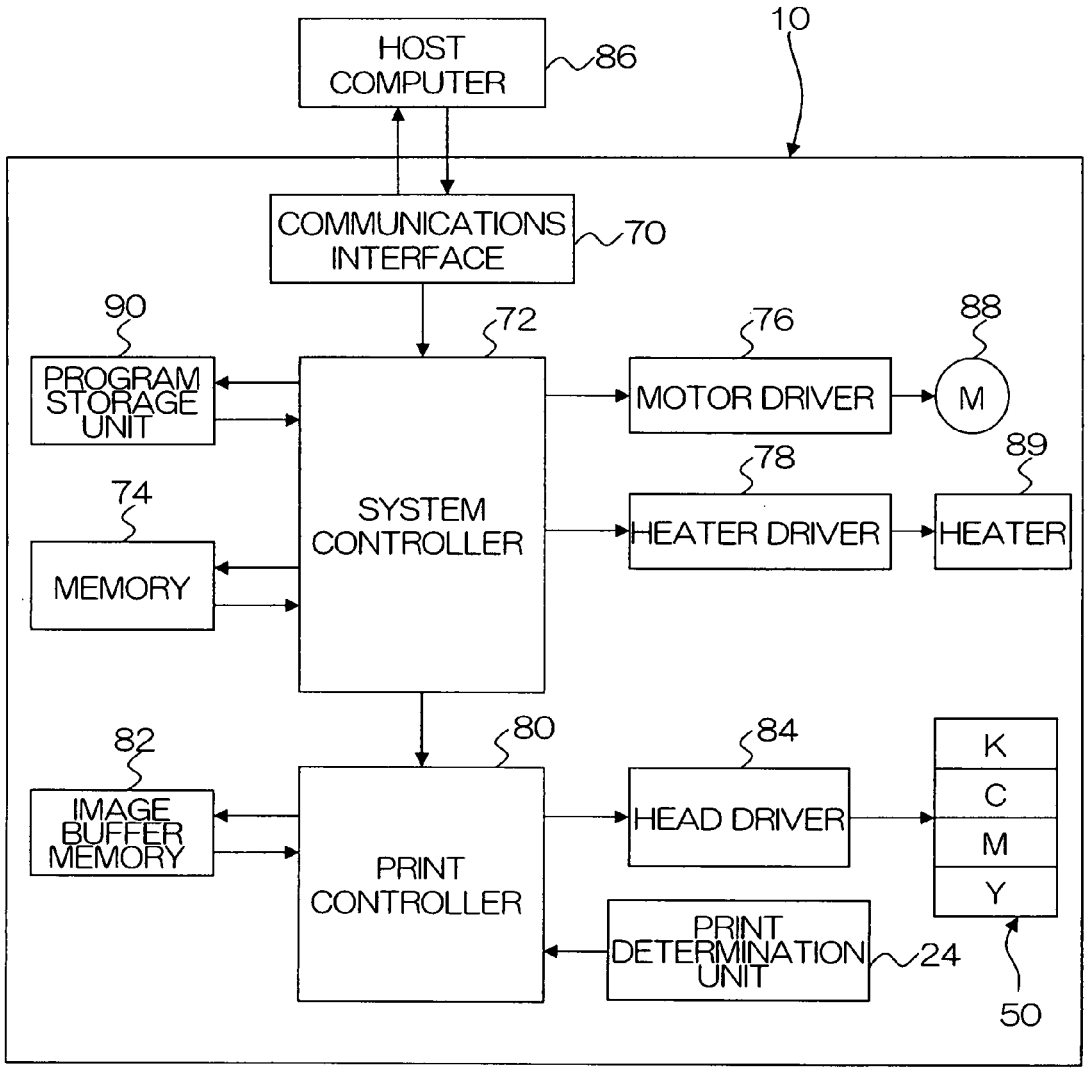
FIG. 14 is a principal block diagram showing the system configuration of an image forming apparatus according to an embodiment of the present invention.

FIG. 14 is a principal block diagram showing the system configuration of the inkjet recording apparatus 10. The inkjet recording apparatus 10 includes a communications interface 70, a system controller 72, a memory 74, a motor driver 76, a heater driver 78, a print controller 80, an image buffer memory 82, a head driver 84, and the like.

The communications interface 70 is an interface unit for receiving image data sent from a host computer 86. A serial interface such as USB (Universal serial bus), IEEE1394, Ethernet™, wireless network, or a parallel interface such as a Centronics interface may be used as the communications interface 70. A buffer memory (not shown) may be mounted in this portion in order to increase the communication speed. The image data sent from the host computer 86 is received by the inkjet recording apparatus 10 through the communications interface 70, and is temporarily stored in the memory 74. The memory 74 is a storage device for temporarily storing images inputted through the communications interface 70, and data is written and read to and from the memory 74 through the system controller 72. The memory 74 is not limited to a memory composed of semiconductor elements, and a hard disk drive or another magnetic medium may be used.

The system controller 72 is a control unit for controlling the various sections, such as the communications interface 70, the memory 74, the motor driver 76, the heater driver 78, and the like. The system controller 72 is constituted by a central processing unit (CPU) and peripheral circuits thereof, and the like, and in addition to controlling communications with the host computer 86 and controlling reading and writing from and to the memory 74, and the like, it also generates control signals for controlling the motor 88 of the conveyance system and the heater 89.

The motor driver (drive circuit) 76 drives the motor 88 in accordance with commands from the system controller 72. The heater driver (drive circuit) 78 drives the heater 89 of the post-drying unit 42 (shown in FIG. 1) and the like in accordance with commands from the system controller 72.

The print controller 80 has a signal processing function for performing various tasks, compensations, and other types of processing for generating print control signals from the image data stored in the memory 74 in accordance with commands from the system controller 72 so as to supply the generated print control signals to the head driver 84. Prescribed signal processing is carried out in the print controller 80, and the ejection amount and the ejection timing of the ink droplets from the respective print heads 50 are controlled (droplet ejection control is performed) via the head driver 84, on the basis of the print data. By this means, desired dot size and dot positions can be achieved.

The print controller 80 is provided with the image buffer memory 82; and image data, parameters, and other data are temporarily stored in the image buffer memory 82 when image data is processed in the print controller 80. The aspect shown in FIG. 14 is one in which the image buffer memory 82 accompanies the print controller 80; however, the memory 74 may also serve as the image buffer memory 82. Also possible is an aspect in which the print controller 80 and the system controller 72 are integrated to form a single processor.

The head driver 84 drives the piezoelectric elements 58 of the heads of the respective colors 12K, 12C, 12M, and 12Y on the basis of print data supplied by the print controller 80. The head driver 84 can be provided with a feedback control system for maintaining constant drive conditions for the print heads.

Various control programs are stored in a program storage section 90, and a control program is read out and executed in accordance with commands from the system controller 72. The program storage section 90 may use a semiconductor memory, such as a ROM, EEPROM, or a magnetic disk, or the like. Furthermore, an external interface may be provided, and a memory card or PC card may also be used. Naturally, a plurality of these storage media may also be provided. The program storage section 90 may also be combined with a storage device for storing operational parameters, and the like (not shown).

The print determination unit 24 is a block that includes the line sensor as described above with reference to FIG. 1, reads the image printed on the recording paper 16, determines the print conditions (presence of the ejection, variation in the dot formation, and the like) by performing desired signal processing, or the like, and supplies the determination results of the print conditions to the print controller 80. According to requirements, the print controller 80 makes various corrections with respect to the head 50 on the basis of information obtained from the print determination unit 24.

The system controller 72 and the print controller 80 may be constituted by one processor, and it is also possible to use a device which combines the system controller 72, the motor driver 76, and the heater driver 78, in a single device, or a device which combines the print controller 80 and the head driver in a single device.

Second Embodiment

Next, a second embodiment of the present invention is described below. In the second embodiment, suctioning is carried out while the cap member 63 is moved.

Figure 15:
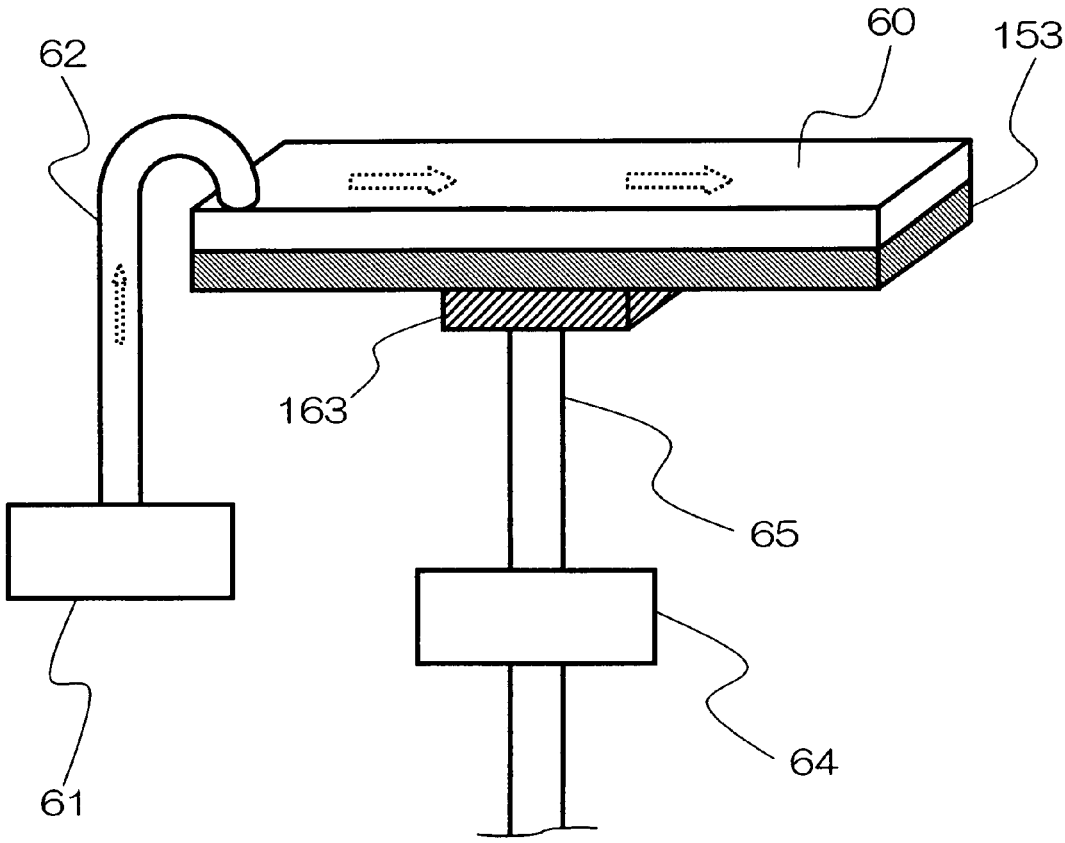
FIG. 15 is a perspective diagram of a liquid ejection apparatus according to a second embodiment of the present invention.

The second embodiment is described with reference to FIG. 15.

In the liquid ejection head of a liquid ejection apparatus (an image forming apparatus), ink is supplied from the ink tank 61, via the ink supply channel 62, to the common liquid chamber 55 inside the common liquid chamber layer 60, and the ink is then supplied to the ejector layer 153.

Figure 16:
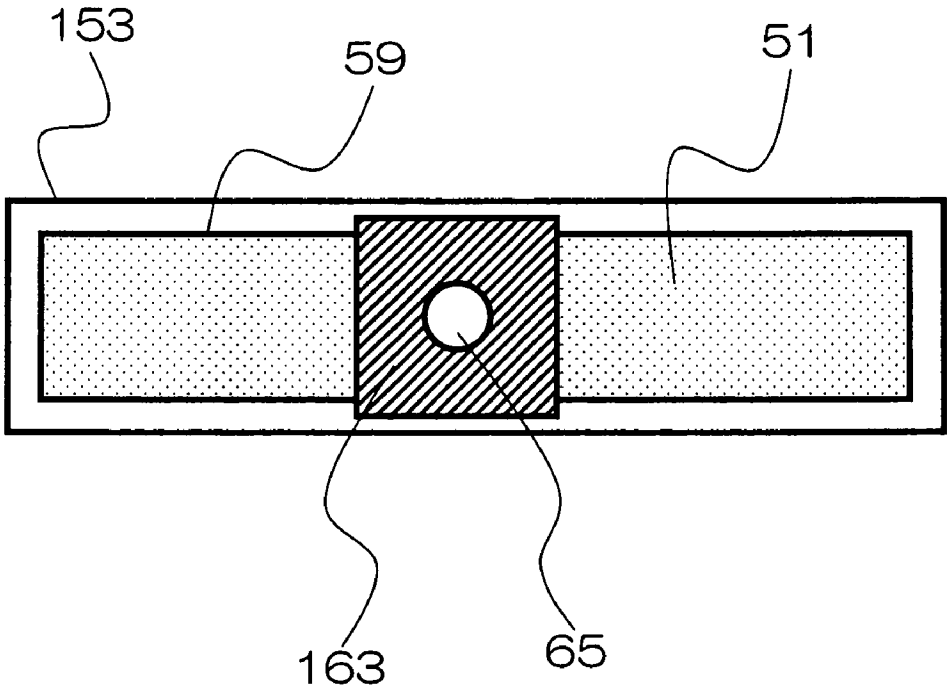
FIG. 16 is a general schematic drawing of a cap member according to a second embodiment of the present invention.

Suctioning is carried out by using a cap member 163. The cap member 163 covers a portion of the nozzles 51 in the nozzle plate 59, as shown in FIG. 16. Suctioning is carried out only for the nozzles 51 located in the region covered by the cap member 163. The suctioning is performed by the suction pump 64, via the ink suctioning channel 65 connected to the cap member 163.

The cap member 163 is movable in the leftward and rightward directions along the surface of the ejector layer 153. Abnormal nozzles 51 (nozzles 51 suffering ejection failures) are determined by the print determination unit 24 in FIG. 1 or an ejection failure determination mechanism (not illustrated) provided for each nozzle 51. When the cap member 163 moves to the abnormal nozzles 51 thus determined, then the suction pump 64 is driven and the nozzles 51 in the region covered by the cap member 163 are suctioned. In this case, suctioning may be controlled by switching the suction pump 64 on and off. Besides, a valve may be provided in the ink suctioning channel 65 between the cap member 163 and the suction pump 64, in order to control suctioning by means of opening and closing this valve.

In this way, by performing suctioning while the cap member 163 covering a portion of the nozzle surface is moved, benefits are obtained in that the cap member 163 can be made small in size, and the cap member 163 can be formed with a simple structure, without the need to provide valves, or the like, therein.

Third Embodiment

Next, a third embodiment of the present invention is described below. An individual filter is provided for each ejector, in a liquid ejection apparatus according to the third embodiment.

Figure 17:
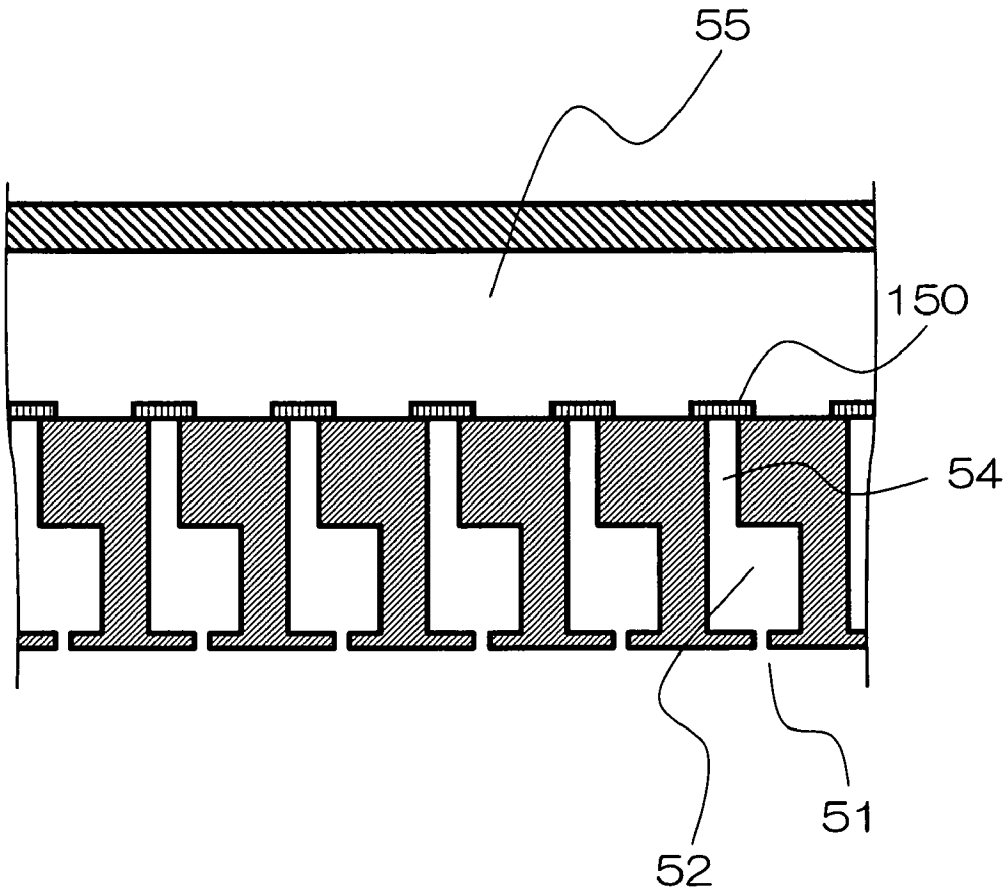
FIG. 17 is a cross-sectional diagram of a liquid ejection head according to a third embodiment of the present invention.

More specifically, as shown in FIG. 17, an individual filter 150 is provided between the common liquid chamber 55 and each of the supply ports 54.

Each individual filter 150 itself has a flow channel resistance. Therefore, if the individual filters 150 are provided, then the flow channel resistance becomes large, compared to a case where there is no flow channel resistance between each nozzle 51 and the common liquid chamber 55.

Figure 18:
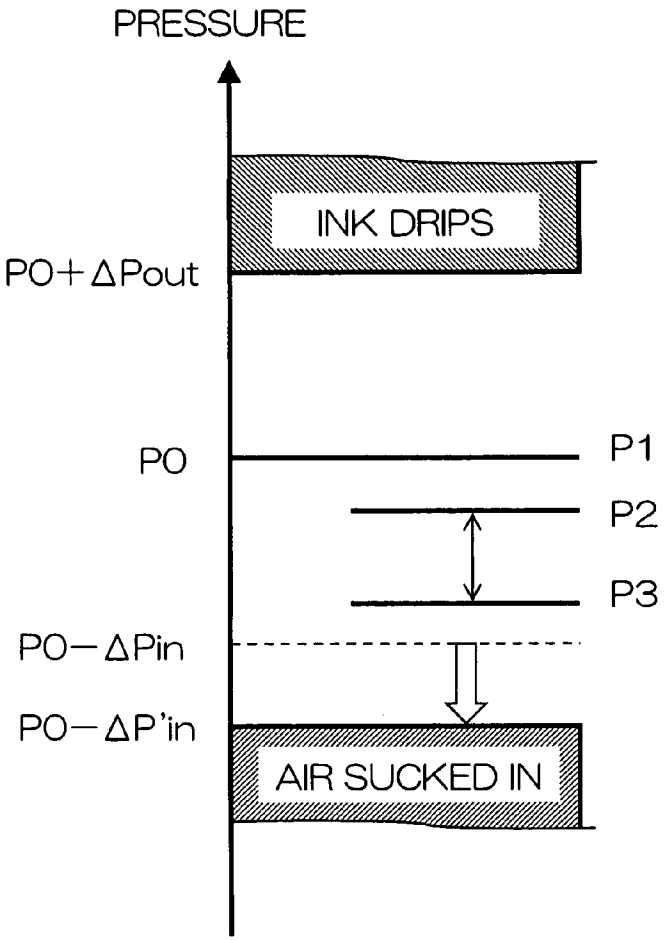
FIG. 18 is a diagram of pressure relationships according to the third embodiment of the present invention.

FIG. 18 is a diagram showing the relationships between pressures in a case where the individual filters 150 are provided.

In cases where the individual filters 150 are not provided, the limit pressure for preventing the reflux of air has a value of "P0−ΔPin" indicated by the dotted line in FIG. 18. By providing the individual filters 150, this limit pressure decreases to a value of P0−ΔP'in, as indicated by the arrow in FIG. 18. Therefore, by providing the individual filters 150, the pressure range in which individual suctioning can be performed is expanded, and the dependence on the suctioning pressure of the suction pump 64 can be reduced.

For example, the individual filters 150 having a mesh size of 5 μm are provided, whereas the nozzle diameter is 25 μm. In this case, the mesh size of the individual filter 150 is five times finer than the nozzle diameter. The value of ΔP' in is calculated on the basis of the Laplace-Young equation, and ΔP'in has a value of approximately 15000 Pa. On the other hand, ΔPin has a value of 3000 Pa in a case where the individual filters 150 are not provided. Hence, the available pressure range (from P0−ΔP'in to P0+ΔPout) in which individual suctioning can be performed has a significantly broader range compared to the available pressure range (from P0−ΔPin to P0+ΔPout) in a case where no individual filter 150 is provided. Accordingly, the pressures P2 and P3 become able to take wider values, and even in cases where the suctioning force created by the suction pump 64 is relatively high, there is no inflow of air via the nozzles 51.

By providing the individual filters 150 in this way, the following benefits can also be obtained. Even if the air flows into a nozzle (the reflux of air occurs) and the meniscus surface 5 at a non-suctioned nozzle 51 breaks, the meniscus is trapped at the individual filter 150, and the meniscus surface 5 is then formed again at the nozzle 51 when suctioning has terminated. Therefore, it is possible to minimize the inflow into the pressure chambers 52 of dirt, or the like, which is liable to accompany the inflow of air. Consequently, no dirt or the like flows into the common liquid chamber 55.

In the present embodiment, an individual filter 150 is arranged between each supply port 54 and the common liquid chamber 55, as described above. However, the present invention is not limited to this, and the individual filters 150 may be arranged inside the supply ports 54, or between the supply ports 54 and the pressure chambers 52, or the like, rather than the arrangement described above.

Fourth Embodiment

A liquid ejection apparatus according to a fourth embodiment has a composition which can pressurize the ink inside the common liquid chamber 55.

If the liquid ejection apparatus is large in size, then the ink supply channel 62 between the ink tank 61 and the common liquid chamber 55 is long and the pressure loss is high.

Figure 19:
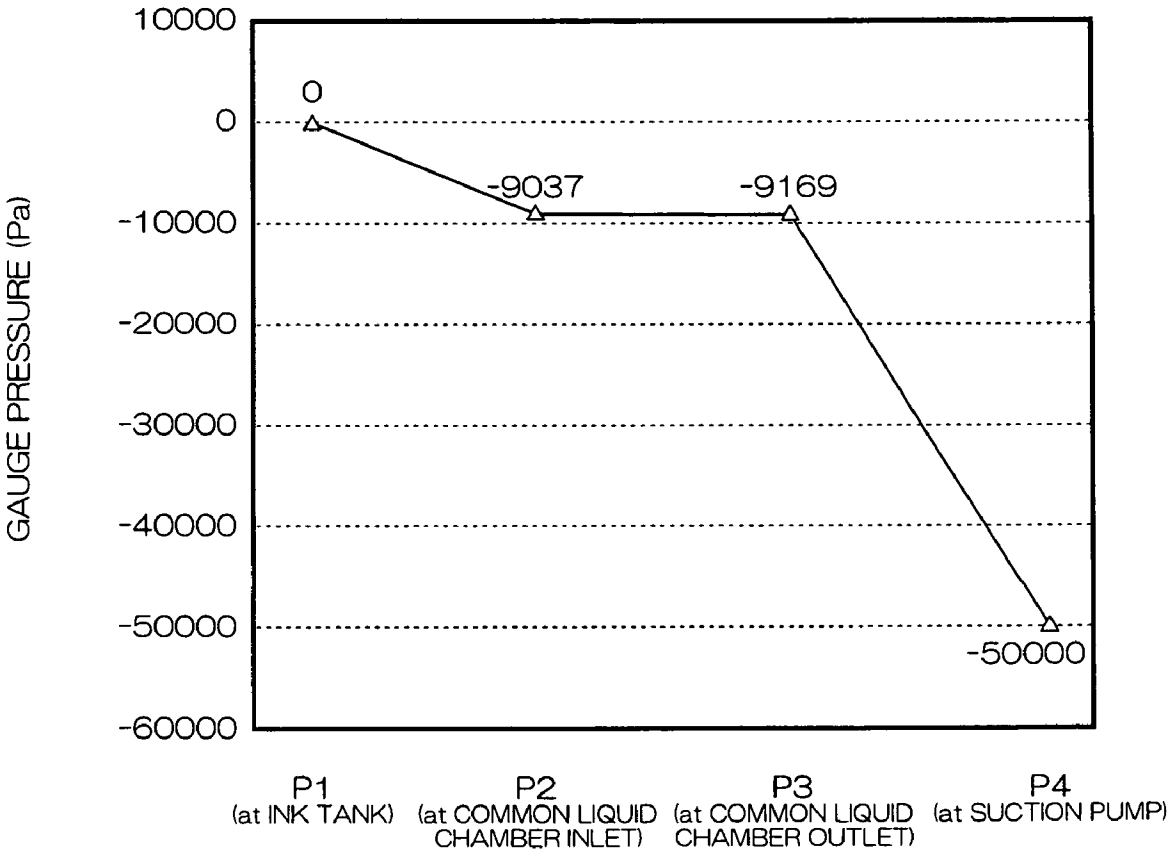
FIG. 19 is a pressure distribution diagram for explaining a fourth embodiment.

FIG. 19 is a diagram showing the pressure values at respective points in a liquid ejection head in a case where the ink supply channel 62 has a length of 1000 mm and an internal diameter of 3 mm. The other conditions are the same as those in the case of the first embodiment.

As shown in FIG. 19, if the ink tank 61 is at the atmospheric pressure and the ink inside the common liquid chamber 55 is not pressurized, then due to the long length of the ink supply channel 62, the pressure value (relative pressure value) P3 at the outlet of the common liquid chamber 55 has a value of −9169 Pa and the pressure value P2 at the inlet of the common liquid chamber 55 has a value of −9037 Pa. Since absolute values of these pressures P2 and P3 exceed the ΔPin (the meniscus maintenance pressure) value of 3000 Pa, then the meniscus cannot be maintained, and the meniscus surface S inside the non-suctioned nozzle 51 is withdrawn and air flows into the non-suctioned nozzle.

By pressurizing the common liquid chamber 55, the pressure value P3 at the outlet of the common liquid chamber 55 and the pressure value P2 at the inlet of the common liquid chamber 55 can be adjusted to have absolute values not more than the ΔPin value of 3000 Pa, which is the meniscus maintenance pressure.

The present embodiment is described with reference to FIG. 20, on the basis of the above description.

In the present embodiment, an ink pressurizing pump 190 is used in order to raise the ink pressure in the common liquid chamber 55 inside the common liquid chamber layer 60.

Figure 20:
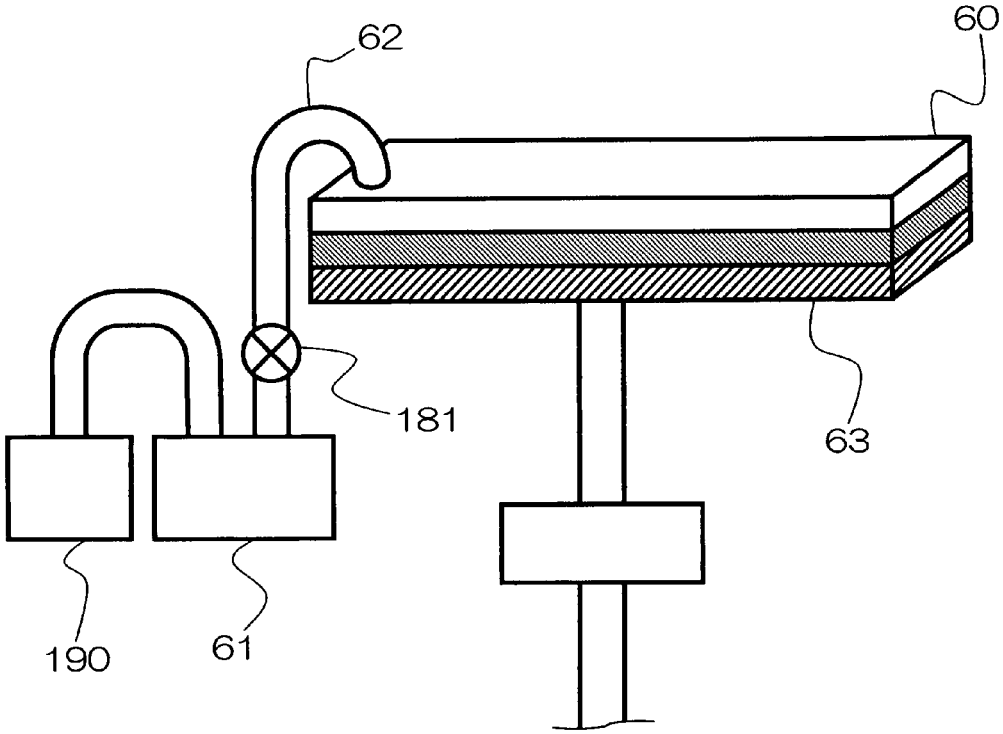
FIG. 20 is a perspective diagram of a liquid ejection apparatus according to a fourth embodiment of the present invention.

After the ink tank 61 is sealed, a valve 181 is provided in the ink supply channel 62 as shown in FIG. 20. The valve 181 is closed, the ink pressurizing pump 190 is set to a prescribed pressure, and then the ink pressurizing pump 190 is turned off. The valve 181 is then opened simultaneously with the start of suctioning. The ink pressures inside the ink tank 61 and the common liquid chamber 55 declines due to the suctioning. However, provided that the suctioning is completed while the absolute value of the pressure P3 at the outlet of the common liquid chamber 55 remains not more than the meniscus maintenance pressure ΔPin of 3000 Pa (before the absolute value of the pressure P3 at the outlet of the common liquid chamber 55 exceeds the meniscus maintenance pressure ΔPin of 3000 Pa), then there arises no inflow of air via the nozzle 51.

Figure 21:
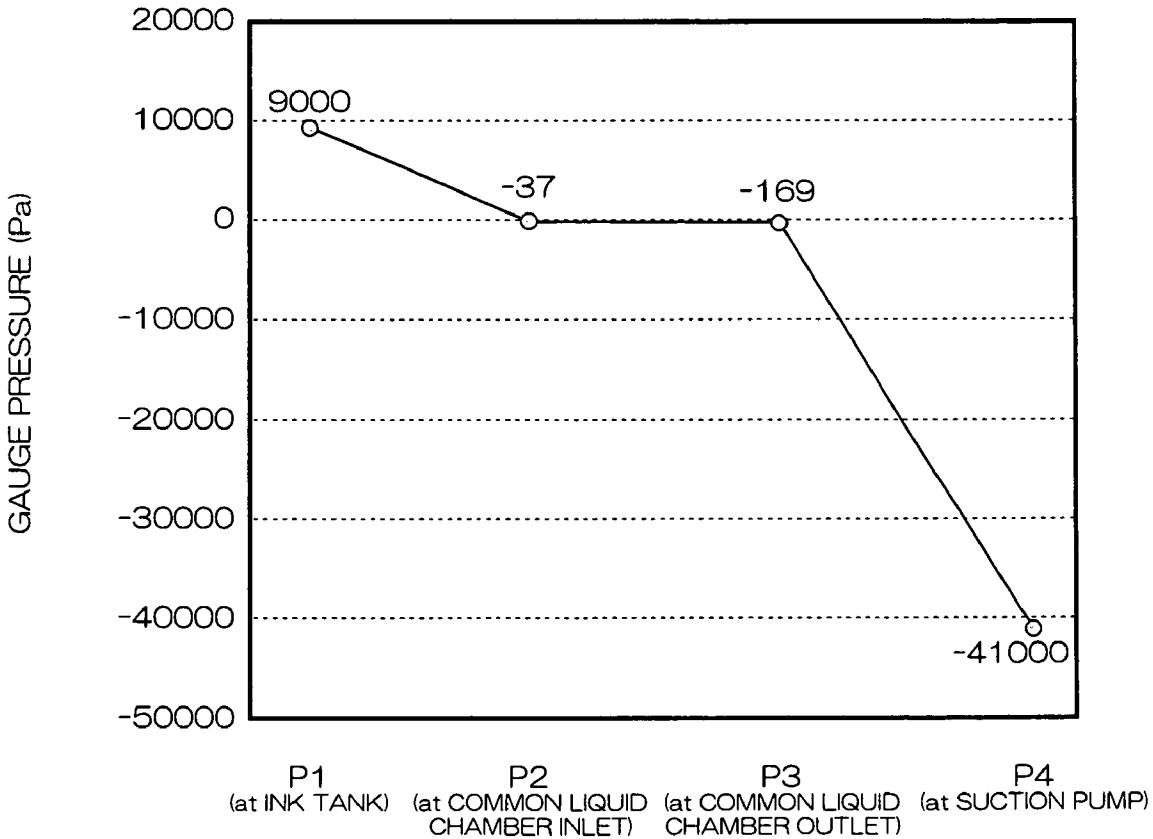
FIG. 21 is a pressure distribution diagram according to the fourth embodiment of the present invention.

FIG. 21 shows pressure values at respective points in a liquid ejection head in a case where the ink inside the common liquid chamber 55 is pressurized by the ink pressurizing pump 190. Similarly to the previous description, the ink supply channel 62 has a length of 1000 mm and an internal diameter of 3 mm, and the ink tank 61 is pressurized to 9000 Pa.

As shown in FIG. 21, if the ink tank 61 is pressurized to 9000 Pa by the ink pressurization pump 190, then all of the pressure values are shifted up by 9000 Pa.

In this case, the pressure value P2 at the inlet of the common liquid chamber 55 has a value of −37 Pa, and the pressure value P3 at the outlet of the common liquid chamber 55 has a value of −169 Pa. Since absolute values of these pressures P2 and P3 come within the meniscus maintenance pressure ΔPin of 3000 Pa, and hence there is no flow of air into the nozzle 51.

The ink pressurization pump 190 may apply a pressure that is substantially proportional to the number of suctioned nozzles 51. This is because the pressure loss in the ink supply channel 62 is directly proportional to the number of suctioned nozzles.

In the present embodiment, the applied pressure value (9000 Pa) was calculated for a case where the number of nozzles 51 to be suctioned is 2200. If the number of suctioned nozzles 51 is 1000, for example, then the applied pressure value should be set to 4090 Pa (≈9000 Pa×1000 nozzles/2200 nozzles). This applies similarly to the embodiments described below.

Figure 22:
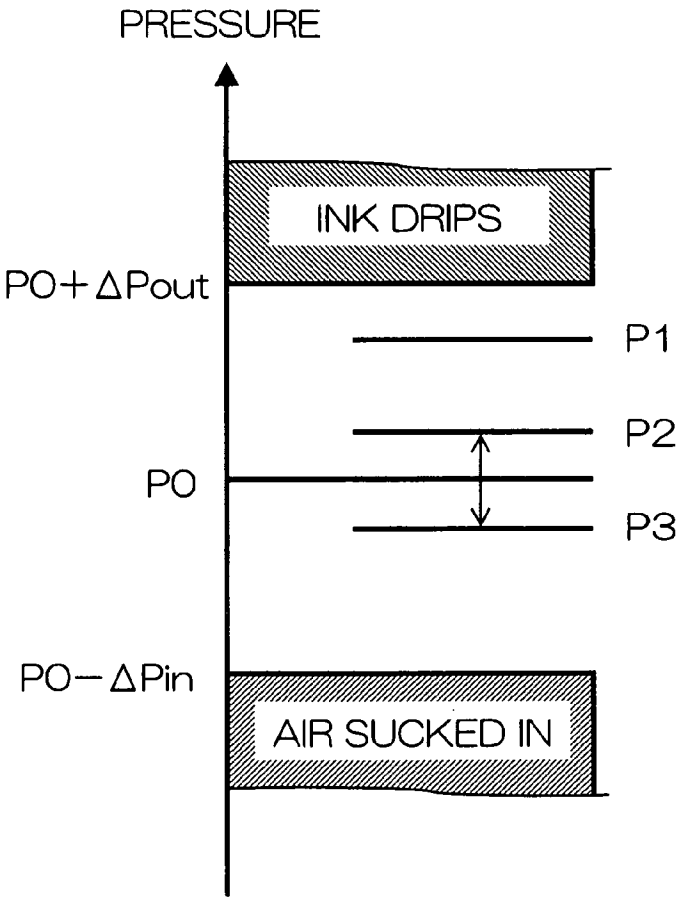
FIG. 22 is a diagram of pressure relationships according to the fourth embodiment of the present invention.

In the present embodiment, pressure is applied to the ink tank 61, and therefore the pressures P1, P2, P3, and P4 have the relationship shown in FIG. 22. In other words, the pressure P1 of the ink inside the ink tank, the pressure P2 at the inlet of the common liquid chamber 55 and the pressure P3 at the outlet of the common liquid chamber 55, are shifted up by an amount corresponding to the pressure applied by the ink pressurization pump 190. During pressurization, the pressure P2 is required not to exceed the value of P0+ΔPout.

Figure 23:
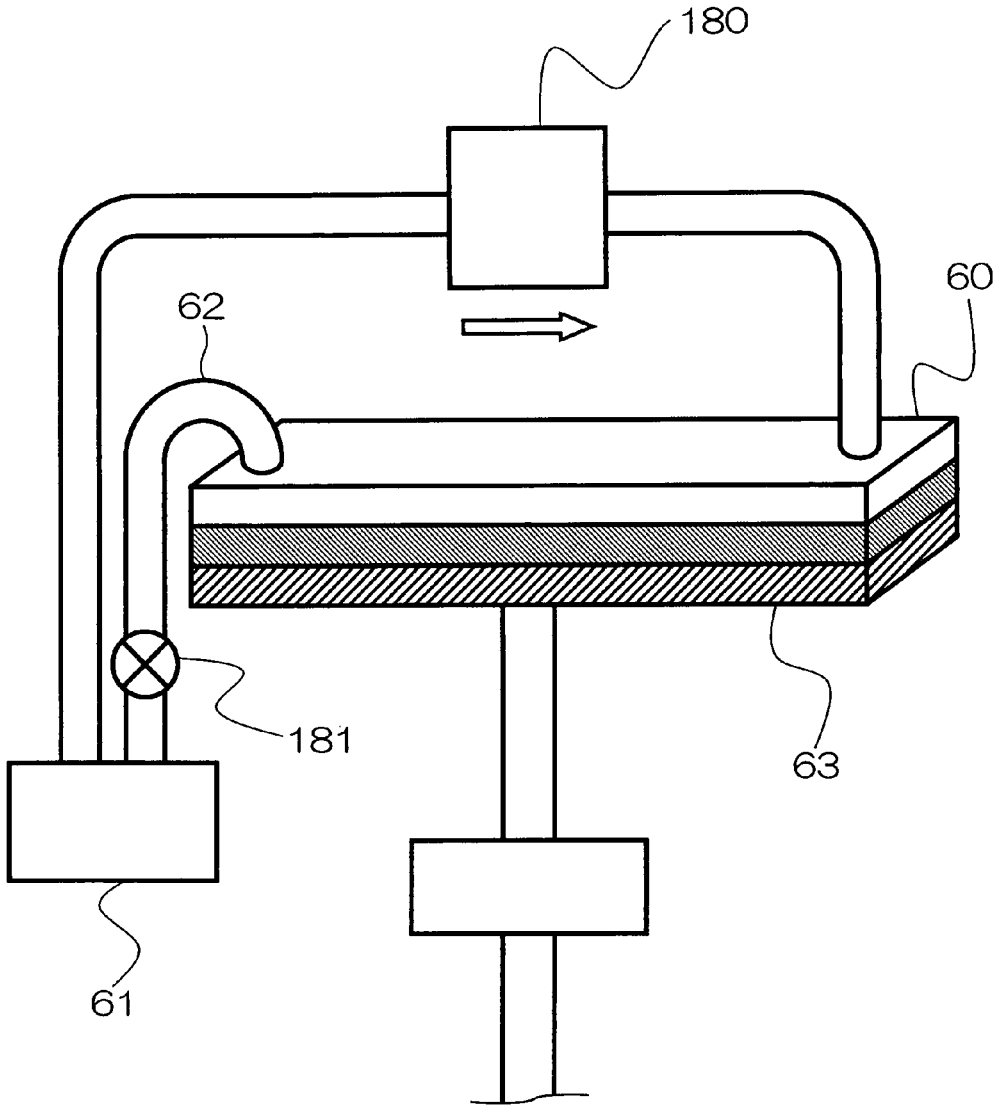
FIG. 23 is a perspective diagram of a further liquid ejection apparatus according to the fourth embodiment of the present invention.

In a modified fourth embodiment, a common liquid chamber circulation pump 180 is provided, as shown in FIG. 23. The common liquid chamber circulation pump 180 is driven after the valve 181 is closed, and the ink is thereby made to flow in the direction of the arrow. The ink in the common liquid chamber 55 in the common liquid chamber layer 60 is thus pressurized by means of the common liquid chamber circulation pump 180, and suctioning is then carried out. Consequently, similar beneficial effects are obtained.

Fifth Embodiment

In a fifth embodiment of the present invention, the position of the ink tank 61 is moved above the liquid ejection head during suctioning.

Figure 24:
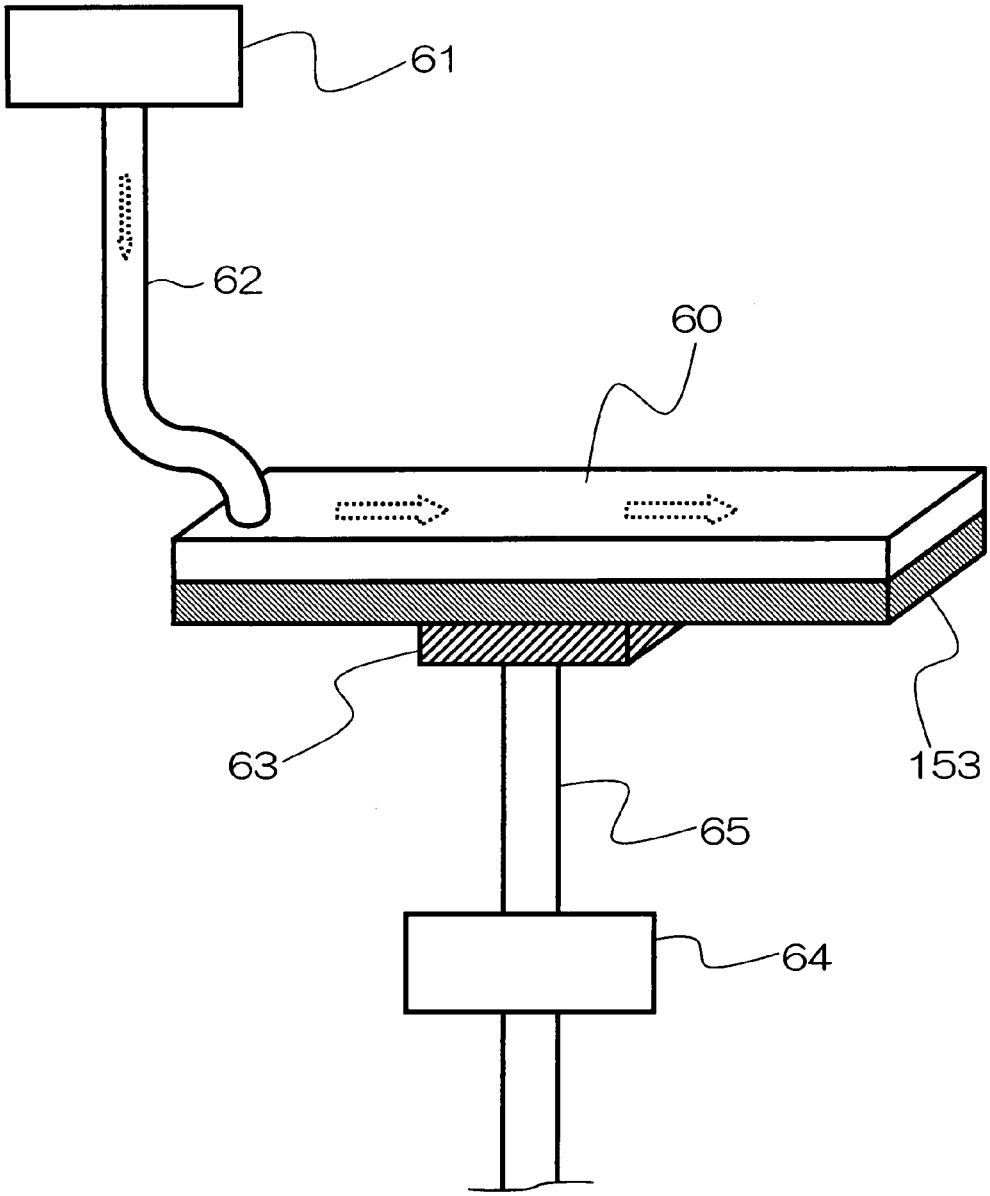
FIG. 24 is a perspective diagram of a liquid ejection apparatus according to a fifth embodiment of the present invention.

FIG. 24 is a diagram showing an illustration of the fifth embodiment.

As shown in FIG. 24, since the ink tank 61 is moved to a position above the common liquid chamber 55 inside the common liquid chamber layer 60, then during suctioning, the ink inside the common liquid chamber 55 is pressurized. Setting the ink tank 61 to a position approximately 900 mm above the common liquid chamber 55 achieves a state where a relative pressure of 9000 Pa is applied to the ink tank 61 (at a height difference of 1000 mm above the ground, a pressure of approximately 10000 Pa is applied). Consequently, similarly to the case shown in FIG. 21, the pressures at respective points of the liquid ejection head are such that the meniscus surface 5 is maintained and there is no reflux of air via the non-suctioned nozzles 51, even when suctioning is being carried out.

Sixth Embodiment

In a sixth embodiment, the pressure inside the common liquid chamber 55 is adjusted by controlling a valve provided between the ink tank 61 and the common liquid chamber 55 in the common liquid chamber layer 60.

Figure 25:
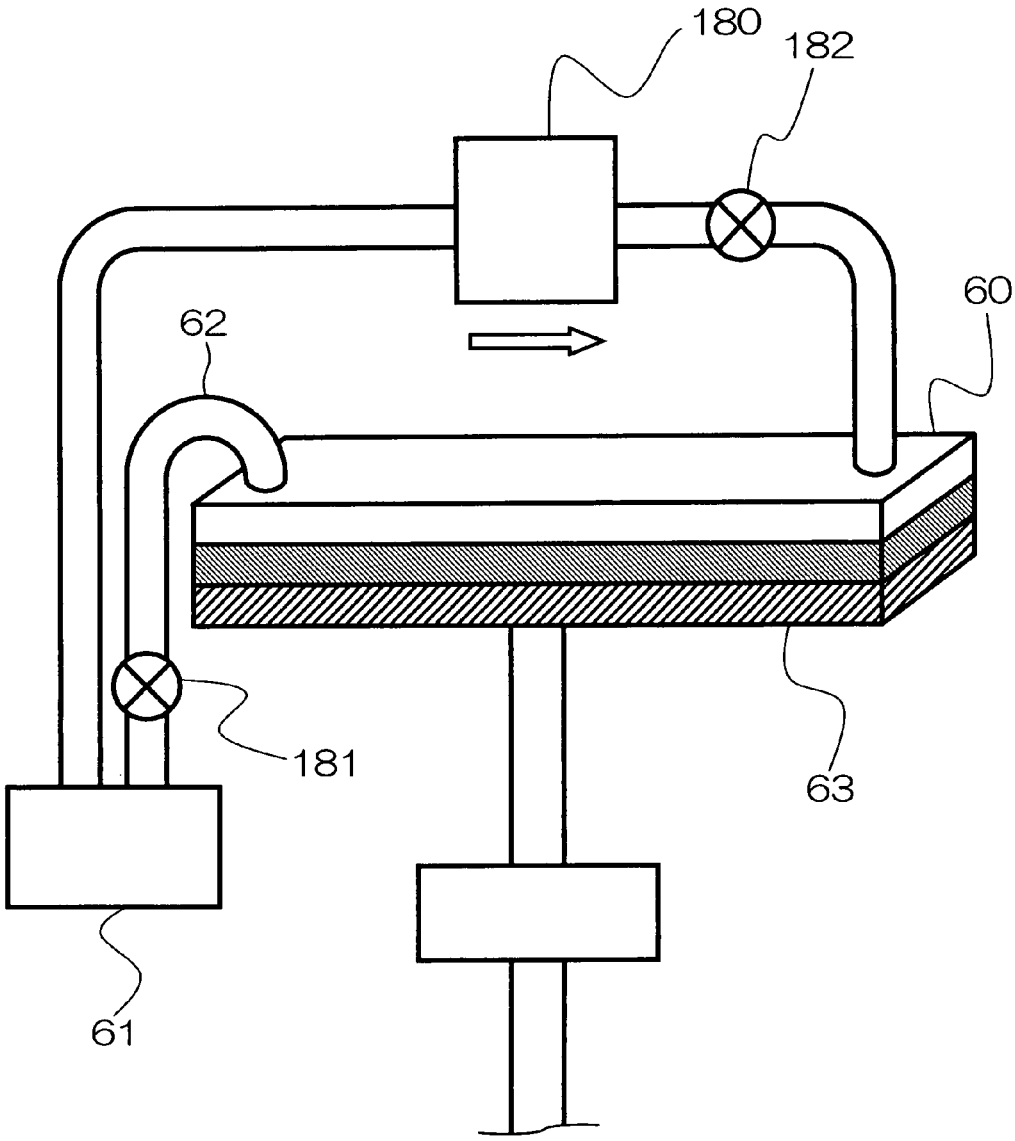
FIG. 25 is a perspective diagram of a liquid ejection apparatus according to a sixth embodiment of the present invention.

For example, as shown in FIG. 25, valves 181 and 182 and a common liquid chamber circulation pump 180 are provided, and the common liquid chamber circulation pump 180 is operated during suctioning. The valve 181 is provided in the ink supply channel 62 between the ink tank 61 and the common liquid chamber layer 60; the valve 182 and the common liquid chamber circulation pump 180 are provided in another ink supply channel which connects the ink tank 61 with the common liquid chamber layer 60; and the valve 182 is located between the common liquid chamber circulation pump 180 and the common liquid chamber layer 60. The flow rate is adjusted by means of the valve 182 (the flow resistance inside the ink supply channel is adjusted by means of the valve 182) while the valve 181 is in a closed state. Thereby, it is possible to adjust the pressure of the ink inside the common liquid chamber 55 in the common liquid chamber layer 60, rather than adjusting the output of the common liquid chamber circulation pump 180.

Figure 26:
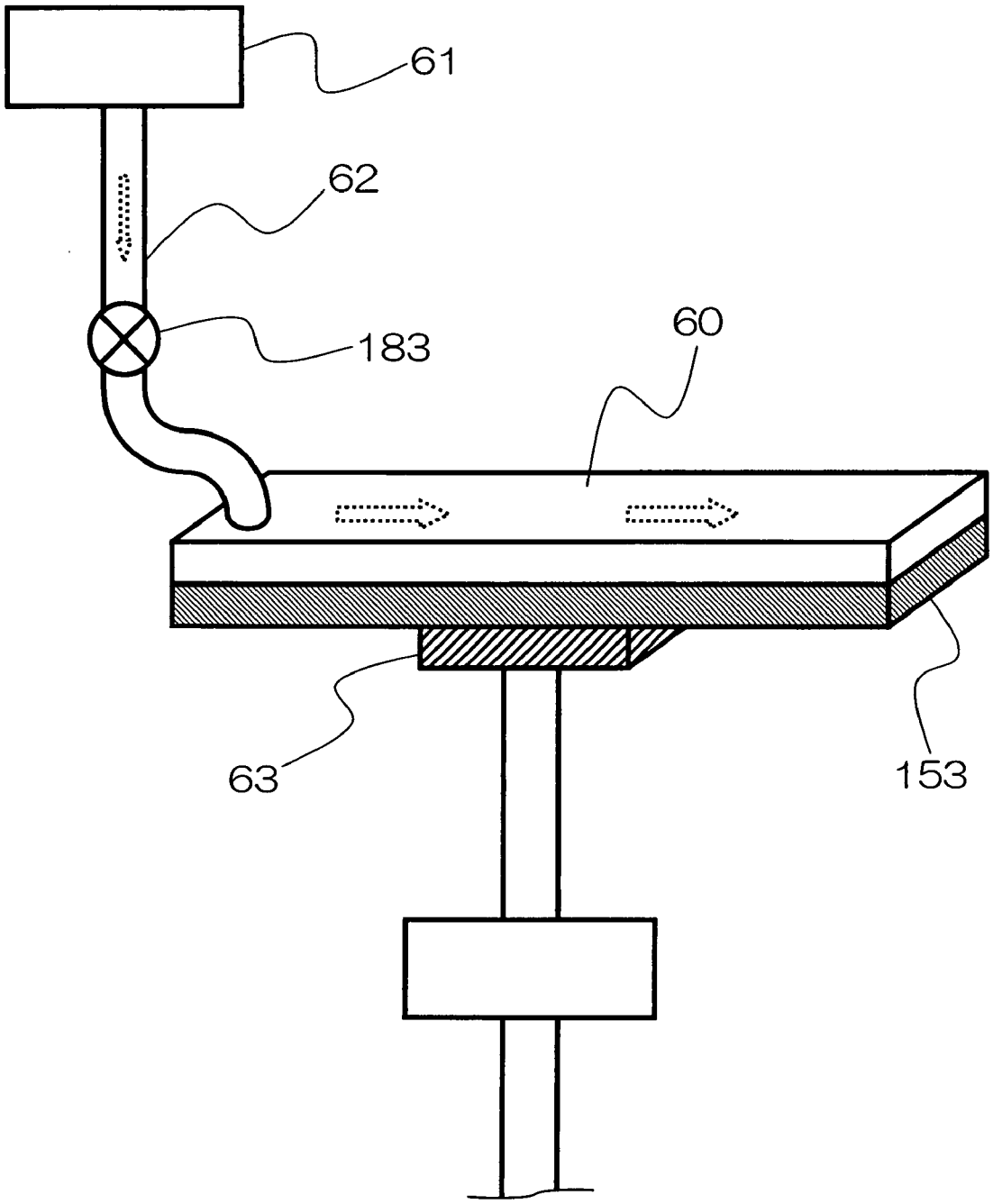
FIG. 26 is a perspective diagram of a further liquid ejection apparatus according to a sixth embodiment of the present invention.

Moreover, as shown in FIG. 26, a valve 183 is provided in the ink supply channel 62 which connects the ink tank 61 with the common liquid chamber layer 60, and a composition is adopted where the ink tank 61 is moved upwards during suctioning (for example, the ink tank 61 is moved upwards so as to be situated higher than the common liquid chamber layer 60). The flow rate is adjusted (the flow resistance inside the ink supply channel 62 is adjusted) by means of the valve 183, rather than adjusting the movement position of the ink tank 61. Thereby, it is possible to apply a desired pressure to the ink inside the common liquid chamber 55 in the common liquid chamber layer 60, without adjusting the movement position of the ink tank 61 when it is moved upwards.

Seventh Embodiment

In a seventh embodiment of the present invention, the ink inside the common liquid chamber 55 in the common liquid chamber layer 60 is pressurized by tilting the whole liquid ejection apparatus from a horizontal position while suctioning is carried out.

Figure 27:
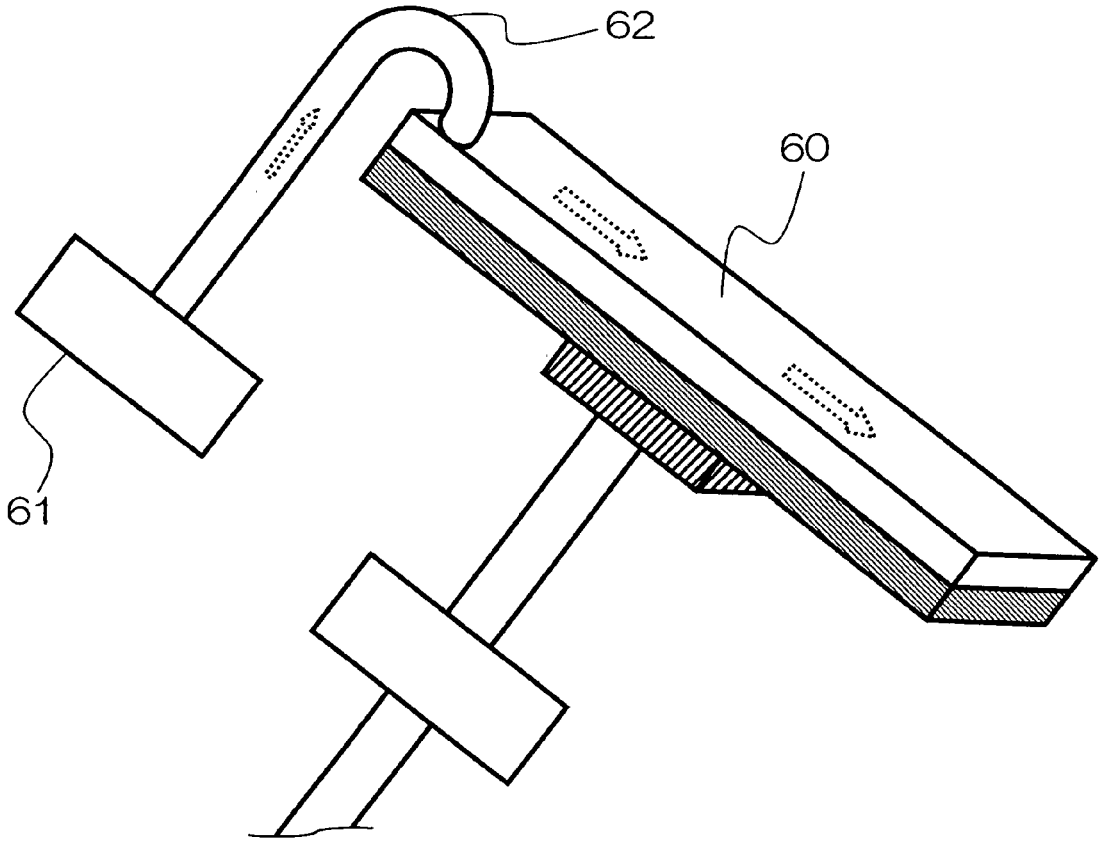
FIG. 27 is a perspective diagram of a liquid ejection apparatus according to a seventh embodiment of the present invention.

FIG. 27 is a diagram showing an illustration of the present embodiment.

As shown in FIG. 27, during suctioning, the apparatus is tilted in such a manner that the connecting section between the common liquid chamber layer 60 and the ink supply channel 62 through which ink is supplied from the ink tank 61, is situated at an upper position.

For example, the common liquid chamber 55 and the liquid ejection head have substantially equal lengths of 300 mm, and the liquid ejection head (e.g., the flow direction of the ink in the common liquid chamber 55) is tilted by 30 degrees from a horizontal position. In this case, the height differential between the both ends of the common liquid chamber 55 is 150 mm, and hence the lower end of the common liquid chamber 55 becomes at a pressure higher than the upper end by 1500 Pa. The pressure differential inside the common liquid chamber 55 can thus be eliminated. If the liquid ejection apparatus is not tilted (remains in a horizontal state), then the reflux of air is liable to occur especially in nozzles located at an end of the common liquid chamber layer 60 far from the ink supply channel 62. However, by tilting the liquid ejection apparatus as described above, the reflux of air or the like can be prevented from occurring only in some nozzles 51 of the liquid ejection head.

Figure 28:
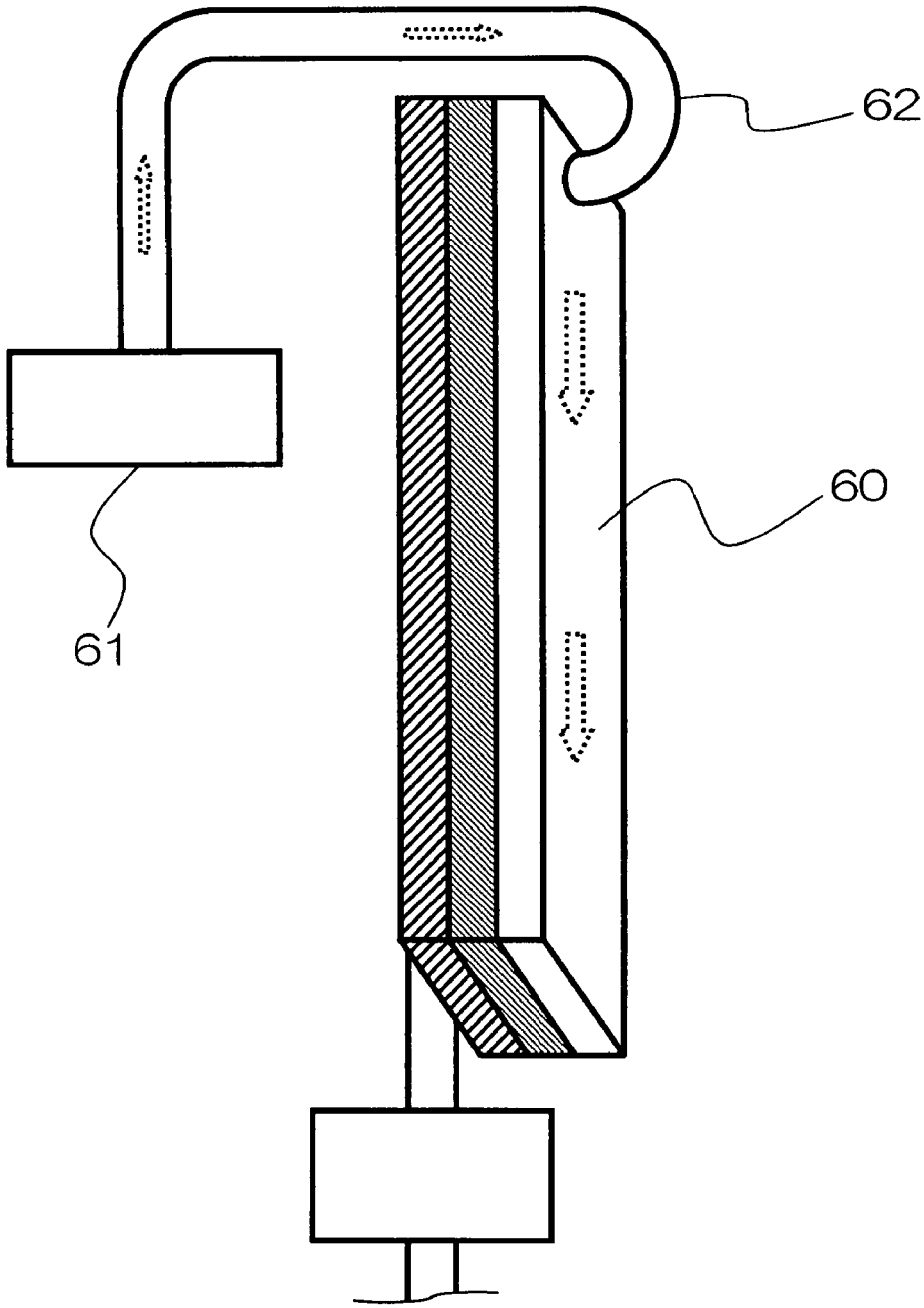
FIG. 28 is a perspective diagram of a further liquid ejection apparatus according to the seventh embodiment of the present invention.

Moreover, in order to create a maximum pressure differential between the both ends of the common liquid chamber 55, it is also possible to set the liquid ejection head vertically, with the connecting section between the ink supply channel 62 and the common liquid chamber layer 60 in an upper position, as shown in FIG. 28.

Eighth Embodiment

In an eighth embodiment of the present invention, the pressure in the ink tank 61 is further raised.

If there is reflux of air via a nozzle 51, then this causes dirt or the like to flow into the nozzle 51, and consequently, considerable damages may be caused to the liquid ejection apparatus (for example, it becomes difficult to eject ink from the nozzle 51). On the other hand, in cases where ink drips from a nozzle 51, although this is disadvantageous in that it wastes ink and is uneconomical, it does not cause a considerable damage.

Even though ink is wasted in some degree, there are beneficial effects if a liquid ejection head which is unavailable because of such a non-ejection nozzle 51 is restored to be used again.

Therefore, pressures may be adjusted so that the following relationship is satisfied:

$$P0+\Delta P\text{out}<Pn.$$

By increasing the pressure applied to the ink tank 61, it is possible to restore the nozzles 51 which could not be restored by normal suctioning.

As a method of pressurizing the ink tank 61, the method according to any one of the fourth to seventh embodiments can be used.

If all of the nozzles 51 which amount to 15600 in number are suctioned, then the total suctioned ink volume is $8.6\times10^{-6}$ $m^3/s$. If the nozzles 51 to be suctioned are 10% of this total number (15600), then 90% of the total volume ($7.8\times10^{-6}$ $m^3/s$) is wasted.

Figure 29:
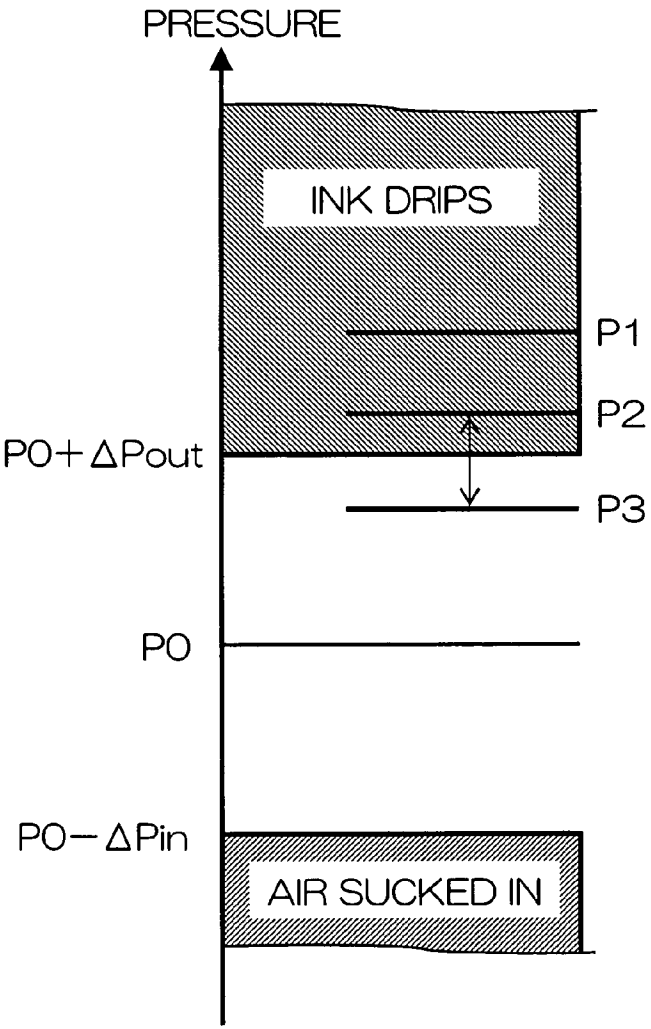
FIG. 29 is a diagram of pressure relationships according to an eighth embodiment of the present invention.

On the other hand, in the present embodiment, as shown in FIG. 29, the common liquid chamber 55 is pressurized in such a manner that the value of P0+ΔPout falls within a range between the pressure value P2 at the inlet of the common liquid chamber 55 and the pressure value P3 at the outlet of the common liquid chamber 55.

Due to this pressurization, ink leaked out from approximately one half of the non-suctioned nozzles 51 (6600 nozzles≈(15600−2200)/2); the flow channel resistance per ejector is $5.0\times10^{13}$ $Ns/m^5$; and the combined flow channel resistance of the 6600 nozzles is $7.5\times10^{9}Ns/m^5$.

Consequently, in the present embodiment, since the ink leaks out when the gauge pressure is approximately 3000 Pa, then the flow rate is $4.0\times10^{-7}$ $m^3/s$ (=3000 Pa/($7.5\times10^{9}$) $Ns/m^5$).

In this way, unnecessary ink wastage can be suppressed to a value of only approximately 5% compared to a case where all of the nozzles are suctioned, and the defective nozzles 51 can thus be restored with only small ink wastage. Moreover, in this case, it is also possible to carry out wet wiping by using the ink that has leaked out.

Liquid ejection apparatuses and image forming apparatuses according to the present invention have been described in detail above, but it should be understood that there is no intention to limit the invention to the specific forms disclosed. On the contrary, the invention is to cover all modifications, alternate constructions and equivalents falling within the spirit and scope of the invention as expressed in the appended claims.

What is claimed is:

1. A liquid ejection apparatus comprising:

a liquid ejection head which comprises nozzles including at least one suctioned nozzle and at least one non-suctioned nozzle and ejecting liquid, pressure chambers supplying the nozzles with the liquid, and a common liquid chamber supplying the pressure chambers with the liquid; and an individual suctioning unit which suctions the liquid in the at least one suctioned nozzle, wherein when the individual suctioning unit suctions the liquid in the at least one suctioned nozzle, a following inequality is satisfied:

$$P0-\Delta P\text{in}<Pn,$$

where Pn is an internal pressure of the at least one non-suctioned nozzle of which the liquid is not suctioned by the individual suctioning unit, and P0−ΔPin is a first limit value of the internal pressure of the at least one non-suctioned nozzle above which air does not flow into the at least one non-suctioned nozzle.

2. The liquid ejection apparatus as defined in claim 1, wherein when the individual suctioning unit suctions the liquid in the at least one suctioned nozzle, a following inequality is further satisfied:

$$P0+\Delta P\text{out}<Pn,$$

where Pn is the internal pressure of the at least one non-suctioned nozzle, and P0+ΔPout is a second limit value of the internal pressure of the at least one non-suctioned nozzle below which the liquid does not drip from the at least one non-suctioned nozzle.

3. The liquid ejection apparatus as defined in claim 1, further comprising filters each of which includes holes having a diameter smaller than a diameter of the nozzles, and which are disposed at positions between the common liquid chamber and the pressure chambers, positions in the pressure chambers, or positions between the pressure chambers and the nozzles.

4. The liquid ejection apparatus as defined in claim 1, wherein the liquid in the common liquid chamber is pressurized when the individual suctioning unit suctions the liquid in the at least one suctioned nozzle.

5. The liquid ejection apparatus as defined in claim 1, further comprising:

an ink tank which supplies the common liquid chamber with the liquid;

an ink supply flow channel which connects the ink tank with the common liquid chamber; and a flow channel adjusting mechanism which is provided in the ink supply flow channel and adjusts a flow channel resistance to a flow of the liquid in the ink supply flow channel so as to be substantially inversely proportional to number of the at least one suctioned nozzle.

6. The liquid ejection apparatus as defined in claim 1, wherein when the individual suctioning unit suctions the liquid in the at least one suctioned nozzle, the liquid ejection head is tilted from a horizontal position in such a manner that one end of the liquid ejection head to which an ink supply flow channel supplying the common liquid chamber with the liquid is connected is situated higher than another end of the liquid ejection head.

7. An image forming apparatus comprising the liquid ejection apparatus as defined in claim 1.

8. A liquid ejection apparatus comprising:

a liquid ejection head which comprises nozzles including at least one suctioned nozzle and at least one non-suctioned nozzle and ejecting liquid, pressure chambers supplying the nozzles with the liquid, and a common liquid chamber supplying the pressure chambers with the liquid; and an individual suctioning unit which suctions the liquid in the at least one suctioned nozzle, wherein when the individual suctioning unit suctions the liquid in the at least one suctioned nozzle, a following inequality is satisfied:

$$P0-\Delta P\text{in}<Pn<P0+\Delta P\text{out},$$

where Pn is an internal pressure of the at least one non-suctioned nozzle of which the liquid is not suctioned by the individual suctioning unit, P0−ΔPin is a first limit value of the internal pressure of the at least one non-suctioned nozzle above which air dose not flow into the at least one non-suctioned nozzle, and P0+ΔPout is a second limit value of the internal pressure of the at least one non-suctioned nozzle below which the liquid dose not drip from the at least one non-suctioned nozzle.

9. The liquid ejection apparatus as defined in claim 8, further comprising filters each of which includes holes having a diameter smaller than a diameter of the nozzles, and which are disposed at positions between the common liquid chamber and the pressure chambers, positions in the pressure chambers, or positions between the pressure chambers and the nozzles.

10. The liquid ejection apparatus as defined in claim 8, wherein the liquid in the common liquid chamber is pressurized when the individual suctioning unit suctions the liquid in the at least one suctioned nozzle.

11. The liquid ejection apparatus as defined in claim 8, further comprising:

an ink tank which supplies the common liquid chamber with the liquid;

an ink supply flow channel which connects the ink tank with the common liquid chamber; and a flow channel adjusting mechanism which is provided in the ink supply flow channel and adjusts a flow channel resistance to the liquid in the ink supply flow channel so as to be substantially inversely proportional to number of the at least one suctioned nozzle.

12. The liquid ejection apparatus as defined in claim 8, wherein when the individual suctioning unit suctions the liquid in the at least one suctioned nozzle, the liquid ejection head is tilted from a horizontal position in such a manner that one end of the liquid ejection head to which an ink supply flow channel supplying the common liquid chamber with the liquid is connected is situated higher than another end of the liquid ejection head.

13. An image forming apparatus comprising the liquid ejection apparatus as defined in claim 8.

* * * * *